US009741327B2

(12) United States Patent
Rutledge et al.

(10) Patent No.: US 9,741,327 B2
(45) Date of Patent: Aug. 22, 2017

(54) AUTOMATIC TRANSCRIPTION OF MUSICAL CONTENT AND REAL-TIME MUSICAL ACCOMPANIMENT

(71) Applicant: HARMAN INTERNATIONAL INDUSTRIES, INC, Stamford, CT (US)

(72) Inventors: Glen A. Rutledge, Victoria (CA); Peter R. Lupini, Victoria (CA); Norm Campbell, Delta (CA)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 14/996,812

(22) Filed: Jan. 15, 2016

(65) Prior Publication Data

US 2016/0210951 A1 Jul. 21, 2016

Related U.S. Application Data

(60) Provisional application No. 62/105,538, filed on Jan. 20, 2015.

(51) Int. Cl.
*G10H 1/38* (2006.01)
*G10H 1/40* (2006.01)

(52) U.S. Cl.
CPC ..... *G10H 1/38* (2013.01); *G10H 1/40* (2013.01); *G10H 2210/005* (2013.01); *G10H 2210/066* (2013.01); *G10H 2210/086* (2013.01); *G10H 2240/081* (2013.01)

(58) Field of Classification Search
CPC ..... G10H 1/38; G10H 1/40
USPC ..... 84/611
See application file for complete search history.

(56) References Cited

U.S. PATENT DOCUMENTS 4,356,752 A * 11/1982 Suzuki ..... G10H 1/38 84/650
4,960,031 A * 10/1990 Farrand ..... G09B 15/023 84/462
5,869,783 A * 2/1999 Su ..... G10H 1/361 84/612

(Continued)

OTHER PUBLICATIONS http://www.sibelius.com/products/audioscore/ultimate.html, "AudioScore Ultimate 8", Mar. 18, 2016, 2 pages.

(Continued)

*Primary Examiner* — David Warren
*Assistant Examiner* — Christina Schreiber
(74) *Attorney, Agent, or Firm* — Brooks Kushman P.C.

(57) ABSTRACT

Various embodiments provide techniques for generating real-time musical accompaniment for musical content included in an audio signal. A real-time musical accompaniment system receives the audio signal via an audio input device. The system extract, from the audio signal, musical information characterizing at least a portion of the musical content. The system generates musical information that has at least one of a rhythmic relationship and a harmonic relationship with the musical information. The system generates an output audio signal that is complementary to the musical information. The system transmits, substantially immediately after receiving the audio signal, the output audio signal to an audio output device.

16 Claims, 11 Drawing Sheets

(56) References Cited

U.S. PATENT DOCUMENTS 6,225,546 B1 * 5/2001 Kraft ..... G10H 1/00 700/94
6,235,979 B1 * 5/2001 Yanase ..... G09B 15/023 84/477 R
6,245,984 B1 * 6/2001 Aoki ..... G10H 1/0025 84/611
7,705,231 B2 * 4/2010 Morris ..... G10H 1/0025 84/610
8,168,877 B1 * 5/2012 Rutledge ..... G10H 1/38 84/613
8,507,781 B2 * 8/2013 Lupini ..... G10H 1/0008 84/611
8,541,676 B1 * 9/2013 Waldman ..... G10H 1/0008 84/603
8,907,195 B1 * 12/2014 Erol ..... G09B 5/06 84/609
9,123,315 B1 * 9/2015 Bachand ..... G10G 1/04
2001/0037196 A1 * 11/2001 Iwamoto ..... G10H 1/366 704/207
2005/0086052 A1 * 4/2005 Shih ..... G06F 17/30743 704/207
2009/0119097 A1 * 5/2009 Master ..... G10H 1/0008 704/207
2011/0203444 A1 * 8/2011 Yamauchi ..... G10H 1/10 84/622
2012/0297958 A1 * 11/2012 Rassool ..... G06F 3/0481 84/609
2014/0053711 A1 * 2/2014 Serletic, II ..... G10H 1/38 84/611
2014/0116233 A1 * 5/2014 Walmsley ..... G06K 9/00496 84/612
2014/0142928 A1 * 5/2014 Campbell ..... G10H 1/0091 704/201
2015/0013527 A1 * 1/2015 Buskies ..... G10H 1/40 84/611
2016/0210947 A1 * 7/2016 Rutledge ..... G10G 1/04
2016/0210951 A1 * 7/2016 Rutledge ..... G10H 1/38
2016/0247496 A1 * 8/2016 Pachet ..... G10H 1/18

OTHER PUBLICATIONS

Partial European Search Report for Application No. 16151847.7, mailed Apr. 11, 2016, 11 pages.
U.S. Office Action for U.S. Appl. No. 14/997,670, mailed Sep. 12, 2016, 7 pages.
Extended European Search Report for Application No. 16151847.7, mailed Aug. 3, 2016, 19 pages.

* cited by examiner

AUTOMATIC TRANSCRIPTION OF MUSICAL CONTENT AND REAL-TIME MUSICAL ACCOMPANIMENT

CROSS-REFERENCE TO RELATED APPLICATIONS

This application claims the benefit of United States provisional patent application titled, "AUTOMATIC TRANSCRIPTION OF MUSICAL CONTENT AND REAL-TIME MUSICAL ACCOMPANIMENT," filed on Jan. 20, 2015 and having Ser. No. 62/105,538. The subject matter of this related application is hereby incorporated herein by reference.

BACKGROUND

The present disclosure relates to audio signal processing, and more specifically, to automatic transcription of musical content and real-time musical accompaniment.

SUMMARY

According to various embodiments of the present disclosure, a method is disclosed for performing automatic transcription of musical content included in an audio signal received by a computing device. The method includes processing, using the computing device, the received audio signal to extract musical information characterizing at least a portion of the musical content. The method further includes generating, using the computing device, a plurality of musical notations representing alternative musical interpretations of the extracted musical information, and applying a selected one of the plurality of musical notations for transcribing the musical content of the received audio signal.

According to various embodiments of the present disclosure, a method is disclosed for performing real-time accompaniment for musical content included in an audio signal received by a computing device. The method includes processing, using the computing device, the received audio signal to extract musical information characterizing at least a portion of the musical content. The method further includes determining, using the computing device, complementary musical information that has at least one of a rhythmic relationship and a harmonic relationship with the extracted musical information, generating a complementary audio signal corresponding to the complementary musical information, and outputting, contemporaneously with the received audio signal, the complementary audio signal using an audio output device coupled with the one or more computer processors.

According to various embodiments of the present disclosure, a method is disclosed for generating real-time accompaniment for musical content included in a first audio signal. The method includes receiving the first audio signal via an audio input device. The method further includes extracting, from the first audio signal, musical information characterizing at least a portion of the musical content. The method further includes generating musical information that is musically compatible with the musical information. The method further includes generating a second audio signal that is complementary to the musical information. The method further includes transmitting, substantially immediately after receiving the audio signal, the second audio signal to an audio output device.

Other embodiments include, without limitation, a computer-readable medium including instructions for performing one or more aspects of the disclosed techniques, as well as a musical accompaniment device for performing one or more aspects of the disclosed techniques.

BRIEF DESCRIPTION OF THE SEVERAL VIEWS OF THE DRAWINGS

So that the manner in which the above recited aspects are attained and can be understood in detail, a more particular description of embodiments of the disclosure, briefly summarized above, may be had by reference to the appended drawings. It is to be noted, however, that the appended drawings illustrate only typical embodiments of this disclosure and are therefore not to be considered limiting of its scope, for the disclosure may admit to other equally effective embodiments.

Figure 1:
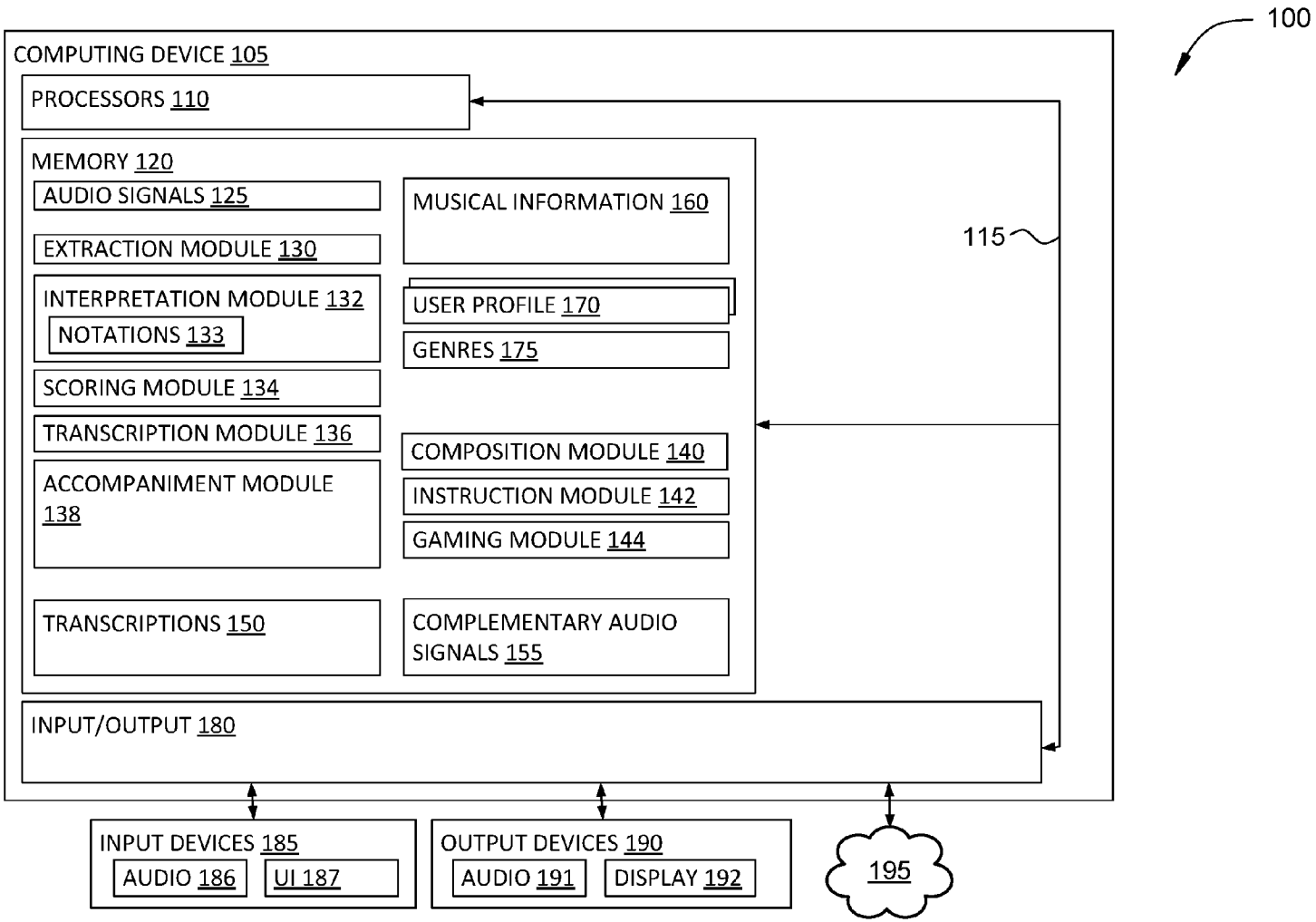
FIG. 1 is a diagram illustrating a system configured to implement one or more aspects of the present disclosure, according to one embodiment.

To facilitate understanding, identical reference numerals have been used, where possible, to designate identical elements that are common to the figures. It is contemplated that elements disclosed in one embodiment may be beneficially utilized on other embodiments without specific recitation. The illustrations referred to here should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

Automatic Transcription of Audio Signals

Several embodiments generally disclose a method, system, and device for performing automatic transcription of musical content included in an audio signal. Information about musical content may be represented in a vast number of different ways, such as digital representations or analog (e.g., sheets of music), using musical symbols in a particular style of notation. Even within a particular style of notation (for example, and without limitation, the staff notation commonly used for written music), ambiguity may allow for alternative interpretations of the same musical information. For example, and without limitation, by altering time signature, tempo, and/or note lengths, multiple competing interpretations could be produced that represent the same musical information. Each of these interpretations may be technically accurate. Therefore, performing accurate transcription of musical content depends on a number of factors, some of which may be subjective, being based on a user's intentions or preferences for the musical information.

FIG. 1 is a diagram illustrating a system configured to implement one or more aspects of the present disclosure, according to various embodiments. System 100 includes a computing device 105 that may be operatively coupled with one or more input devices 185, one or more output devices 190, and a network 195 including other computing devices.

The computing device 105 generally includes processors 110, memory 120, and input/output (or I/O) 180 that are interconnected using one or more connections 115. The computing device 105 may be implemented in any suitable form. Some non-limiting examples of computing device 105 include general-purpose computing devices, such as personal computers, desktop computers, laptop computers, netbook computers, tablets, web browsers, e-book readers, and personal digital assistants (PDAs). Other examples of computing device 105 include communication devices, such as mobile phones and media devices (including recorders, editors, and players such as televisions, set-top boxes, music players, digital photo frames, and digital cameras). In some embodiments, the computing device 105 may be implemented as a specific musical device, such as a digital audio workstation, console, instrument pedal, electronic musical instrument (such as a digital piano), and so forth.

In various embodiments, the connection 115 may represent common bus(es) within the computing device 105. In an alternative embodiment, system 100 is distributed and includes a plurality of discrete computing devices 105 for performing the functions described herein. In such an embodiment, the connections 115 may include intra-device connections (e.g., buses) as well as wired or wireless networking connections between computing devices.

Processors 110 may include any processing elements that are suitable for performing the functions described herein, and may include single or multiple core processors, as well as combinations thereof. The processors 110 may be any technically feasible form of processing device configured to process data and execute program code. The processors 110 could be, for example, and without limitation, a central processing unit (CPU), a graphics processing unit (GPU), an application-specific integrated circuit (ASIC), a field-programmable gate array (FPGA), and so forth. The processors 110 may be included within a single computing device 105, or may represent an aggregation of processing elements included across a number of networked computing devices. The processors 110 execute software applications stored within memory 120 and optionally an operating system. In particular, the processors 110 execute software and then perform one or more of the functions and operations set forth in the present application.

Memory 120 may include a variety of computer-readable media selected for their size, relative performance, or other capabilities: volatile and/or non-volatile media, removable and/or non-removable media, etc. Memory 120 may include cache, random access memory (RAM), storage, etc. Storage included as part of memory 120 may typically provide a non-volatile memory and include one or more different storage elements such as Flash memory, a hard disk drive, a solid state drive, an optical storage device, and/or a magnetic storage device. Memory 120 may be included in a single computing device or may represent an aggregation of memory included in networked computing devices.

Memory 120 may include a plurality of modules used for performing various functions described herein. The modules generally include program code that is executable by one or more of the processors 110, and may be implemented as software and/or firmware. In another embodiment, one or more of the modules is implemented in hardware as a separate application-specific integrated circuit (ASIC). As shown, modules include extraction module 130, interpretation module 132, scoring module 134, transcription module 136, accompaniment module 138, composition module 140, instruction module 142, and gaming module 144. The modules may operate independently, and may interact to perform certain functions. For example, and without limitation, the gaming module 144 during operation could make calls to interpretation module 132, transcription module 136, and so forth. The person of ordinary skill will recognize that the modules provided herein are merely non-exclusive examples; different functions and/or groupings of functions may be included as desired to suitably operate the system 100.

Memory 120 includes one or more audio signals 125. As used herein, a signal or audio signal generally refers to a time-varying electrical signal corresponding to a sound to be presented to one or more listeners. Such signals are generally produced with one or more audio transducers such as microphones, guitar pickups, or other devices. These signals could be processed using, for example, and without limitation, amplification or filtering or other techniques prior to delivery to audio output devices such as speakers or headphones.

Audio signals 125 may have any suitable form, whether analog or digital. The audio signals may be monophonic (i.e., including a single pitch) or polyphonic (i.e., including multiple pitches). Audio signals 125 may include signals produced contemporaneously using one or more input devices 185 and received through input/output 180, as well as one or more pre-recorded files, tracks, streamed media, etc. included in memory 120. The input devices 185 include audio input devices 186 and user interface (UI) devices 187. Audio input devices 186 may include passive devices (e.g., a microphone or pickup for musical instruments or vocals) and/or actively powered devices, such as an electronic instrument providing a MIDI output. User interface devices 187 include various devices known in the art that allow a user to interact with and control operation of the computing device 105 (e.g., keyboard, mouse, touchscreen, etc.).

The extraction module 130 is configured to analyze some or all of the one or more audio signals 125 in order to extract musical information 160 representing various properties of the musical content of the audio signals 125. In various embodiments, the extraction module 130 samples a portion of the audio signals 125 and extracts musical information corresponding to the portion. The extraction module 130 may apply any suitable signal processing techniques to the audio signals 125 to determine characteristics of the musical content included therein. Musical information 160 includes time-based characteristics of the musical content, such as the timing (onset and/or duration) of musical notes. Musical information 160 also includes frequency-based characteristics of the musical content, such as pitches or frequencies (e.g., 440 Hz) of musical notes.

Interpretation module 132 is configured to analyze the musical information 160 and to produce a plurality of possible notations 133 (i.e., musical interpretations) representing the musical information. As discussed above, a vast number of ways exist to represent musical information, which may vary by cultural norms, personal preferences, whether the representation is visually formatted (e.g., sheet music) or processed by computing systems (such as MIDI), and so forth. The interpretation module 132 may interact with other data stored in memory 120 to improve the accuracy of generated notations, such as user profile information 170 and/or musical genre information 175.

Figure 2A:
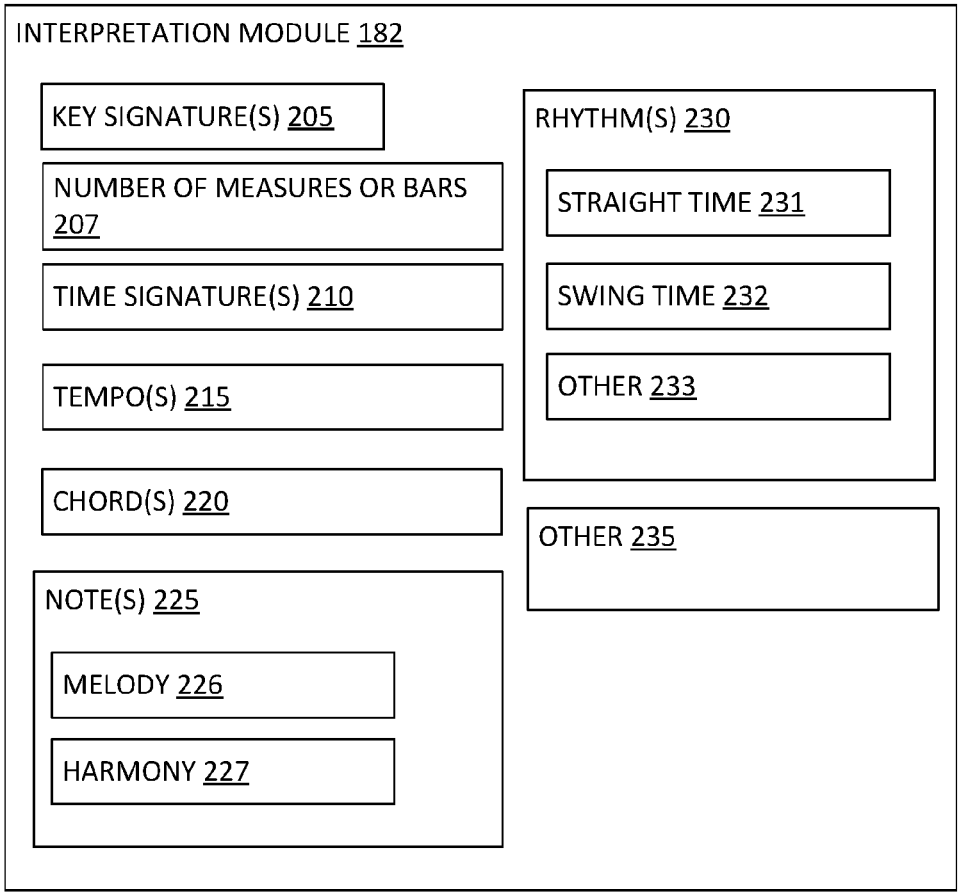
FIGS. 2A and 2B illustrate exemplary musical information and user profiles for use in a system for performing automatic transcription of musical content, according to various embodiments.

Turning to FIG. 2A, the interpretation module 132 may assess the musical information 160 of the audio signals 125 and attempt to accurately classify the information according to a number of different musical characteristics. Some of the characteristics may be predominantly pitch or frequency-based, such as key signatures 205, chords 220, some aspects of notes 225 (e.g., note pitches, distinguishing polyphonic notes), and so forth. Groups of notes 225 may be classified as melody 226 or harmony 227; these parts may be included together in notations 133 or may be interpreted separately. Other characteristics may be predominantly time-based, such as a number of measures or bars 207, time signatures 210, tempos 215, other aspects of notes 225 (e.g., note onsets and lengths), rhythms 230, and so forth. Rhythms 230 may correspond to an overall "style" or "feel" for the musical information, reflected in the timing patterns of notes 225. Examples of rhythms 230 include straight time 231, swing time 232, as well as other rhythms 233 known to a person of ordinary skill in the art (e.g., staccato swing, shuffle, and so forth). The interpretation module 132 may also include other characteristics 235 that would be known to the person of ordinary skill in the art, such as musical dynamics (e.g., time-based changes to signal volumes or amplitudes, velocities, etc.). Additional discussion of musical characteristics is provided with respect to FIGS. 5A and 5B below.

Returning to FIG. 1, the notations 133 generated by the interpretation module 132 may include a plurality of the musical characteristics discussed above. Each notation 133 generated for a particular musical information 160 may include the same set (or at least a partially shared set) of musical characteristics, but one or more values for the shared musical characteristics generally varies between notations. In this way, the notations 133 provide a plurality of alternative representations of the same musical information 160 that are sufficiently distinguishable. Providing the alternative representations may be useful for estimating the notation that the end-user is seeking, which may reflect completely subjective preferences. The alternative representations may accommodate the possibility of different styles of music, and may also be helpful to overcome the minor variability that occurs within a human musical performance. Example notations are discussed below with respect to FIGS. 5A and 5B.

In one implementation of the system 100, a typical scenario may include a musician using a musical instrument (e.g., a guitar) to provide the audio signal 125. To indicate that a musical phrase in the audio signal 125 should be learned by an algorithm executed using processors 110, the musician may step on a footswitch or provide an alternate indication that the musical phrase is beginning about the time that the first notes are played. The musician plays the musical phrase having a particular time signature (e.g., 3/4 or 4/4) and a particular feel (e.g., straight or swing), with the associated chords optionally changing at various points during the phrase. Upon completion of the phrase, the musician may provide another indication (e.g., step on the footswitch again). The beginning of the phrase could also be indicated by instructing (i.e., "arming") the algorithm to listen for the instrument signal to cross a certain energy level rather than using a separate indication. In various embodiments, a more accurate location for the start and end of the musical phrase can be determined by searching for a closest note onset within a range (e.g., +/−100 ms) of the start and end indicated by the user.

While the phrase is being played, real-time analysis of the audio signal 125 (e.g., the instrument signal from the guitar) is performed by the system 100. For example, and without limitation, polyphonic note detection could be used to extract the note pitches that are played (e.g., strums on the guitar) and onset detection can be used to determine the times at which the guitar was strummed or picked. In addition to determining the times of the strums, features can be extracted corresponding to each strum, which can later be used in a full analysis to correlate strums against each other to determine strum emphasis (e.g., bar start strums, downstrums or upstrums, etc.). For example, and without limitation, the spectral energy in several bands could be extracted as a feature vector for each onset.

When the musician indicates the end of the musical phrase, the interpretation module 132 can perform a full analysis to produce multiple notations corresponding to the phrase. In various embodiments, the full analysis works by hypothesizing a notation for the musical phrase and then scoring the detected notes and onsets against the hypothesis. For example, and without limitation, one notation could include 4 bars of 4/4 straight feel timing. In this case, we could expect to find onsets at or near the quarter and eighth note locations, which can be estimated by dividing the phrase into 32 sections (i.e., 4 bars×8 notes per bar). The notation generally receives a higher score if the detected onsets occur at the expected locations of quarter notes/eighth notes. In various embodiments, a greater scoring weight is applied to the quarter notes when compared to the eighth notes, and an even greater scoring weight is applied to onsets corresponding to the start of a bar. Using the features extracted for each onset, a similarity measure can be determined for each of the onsets detected. The onset score is increased if the onsets associated with the start of a bar have a high similarity measure.

The notes may also be analyzed to determine whether specific chords were played. In various embodiments, an interpretation may be more likely where timing of the chord changes occurs near bar boundaries. In various embodiments, a chord change score may is included in the overall calculation of the notation score. In addition, a priori scores can be assigned to each notation based on what is more likely to be played. For example, and without limitation, a larger a priori score could be assigned to a 4/4 notation over a 3/4 notation, or a larger a priori score could be assigned to an even number of bars over an odd number of bars. By appropriately scaling the scores (e.g., between 0 and 1), the overall score for a notation may be computed by multiplying the onset score by the chord change score and the a priori score. Due to the large number of possible notations for a musical phrase, standard methods of dynamic programming can be used to reduce the computational load.

In some cases, the scores for different notation hypotheses may be very close (see, e.g., FIG. 5A), resulting in difficulty in choosing a single "correct" notation. For this reason, a top-scoring subset of the notation hypotheses may be provided to an end-user with an easy method to select the notation hypothesis without tedious editing. In various embodiments, a single "alternate timing" button may be used to alternate between the notation hypotheses having the two greatest scores. In various embodiments, a user interface (UI) element such as a button or knob may be used to alternate from the best notation of a particular type (e.g., a 4/4 notation) to the best notation of a different type (e.g., a 3/4 notation).

The plurality of notations 133 represents different musical interpretations of the musical information 160. The scoring module 134 is configured to assign scores to each of the generated notations 133 based on a measure of matching the audio signal 125 or a portion of the audio signal 125 (corresponding to the musical information 160). Any suitable algorithm may be used to determine or quantify the relative matching. In some embodiments, matching may be done directly, i.e., comparing the sequence of notes 225 and/or chords 220 determined for a particular notation 133 with the audio signal 125. In various embodiments, variations in timing and/or pitch of notes between the notation 133 and the audio signal may be determined. For example, and without limitation, the extraction module 130 during processing could determine a note included within the audio signal to have a particular time length (say, 425 milliseconds (ms)). Assume also that one of the notations generated by the interpretation module 132 includes a tempo of 160 beats per minute (bpm) in straight time, with a quarter note corresponding to one beat. For this example, a quarter note would be expected to have a time value of 0.375 s or 375 ms (i.e., 60 s/min divided by 160 bpm). The interpretation module may consider the 425 ms note to be sufficiently close to the expected 375 ms to classify the note as a quarter note (perhaps within a predetermined margin to accommodate user imprecision). Alternatively, the interpretation module may consider this classification as the best possible classification considering the particular notation parameters; for example, and without limitation, the next closest possible note classification could be a dotted quarter note having an expected time value of 562.5 ms (1.5×375 ms). Here, the error is less when classifying the 425 ms note as a quarter note (50 ms) than when classifying the note as a dotted quarter note (137.5 ms). Of course, the interpretation module may apply additional or alternative logic to individual notes or groupings of notes to make such classifications. The amounts of error corresponding to the classification of individual notes or groupings of notes may be further processed to determine an overall matching score of the notation 133 to the audio signal 125. In some embodiments, the amounts of error may be aggregated and/or weighed to determine the matching score.

In some embodiments, the measure of matching and score calculation may also be based on information included in one or more user profiles 170, as well as one or more selected or specified genres 175 for the audio signal 125/musical information 160. Genres 175 generally include a number of different broad categories of music styles. A selected genre may assist the interpretation module 132 in accurately processing and interpreting the musical information 160, as genres may suggest certain musical qualities of the musical information 160 (such as rhythm information, expected groups of notes/chords or key signatures, and so forth). Some examples of common genres 175 include rock, country, rhythm and blues (R&B), jazz, blues, popular music (pop), metal, and so forth. Of course, these examples generally reflect Western music preferences; genres 175 may also include musical styles common within different cultures. In various embodiments, the genre information may be specified before the interpretation module 132 operates to interpret the musical information 160. In various embodiments, the genre 175 for the audio is signal is selected by an end-user via an element of the UI 187.

Figure 2B:
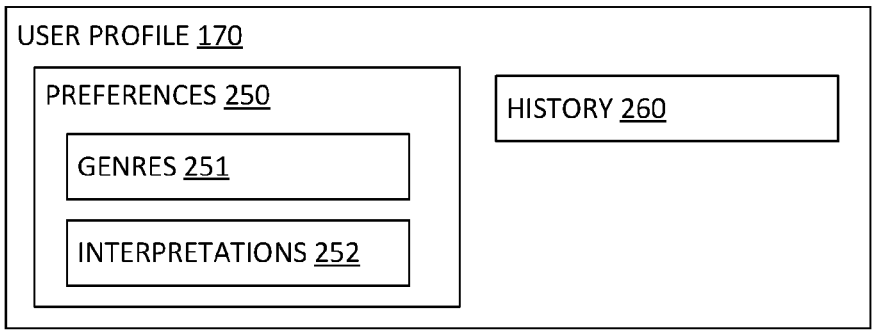

Turning to FIG. 2B, a user profile 170 may include preference information 250 and history information 260 specific to an end-user. History information 260 generally includes information related to the end-user's previous sessions using the system 100, and tends to show a user's musical preferences. History information 260 may include data that indicates previous instances of musical information 160, a corresponding genre 175 selected, a corresponding notation 133 selected, notations 133 not selected, and so forth. The end-user's preferences 250 may be explicitly determined or specified by the end-user through the UI 187, or may be implicitly determined by the computing device 105 based on the end-user's interactions with various functions/modules of the system 110. Preferences 250 may include a number of different categories, such as genre preferences 251 and interpretation preferences 252.

The scoring module 134 may consider user profiles 170 (for the particular end-user and/or other end-users) and the genre 175 when scoring the notations 133. For example, and without limitation, assume one end-user's history 260 indicates a strong genre preference 251 for metal. Consistent with the metal genre, the end-user may also have interpretation preferences 252 for fast tempos and a straight time feel. When scoring a plurality of notations 133 for the particular end-user, the scoring module 134 may generally give a lower score to those notations having musical characteristics that are comparable to different genres (such as jazz or R&B), having slower tempos, a swing time feel, and so forth. Of course, in other embodiments, the scoring module 134 may consider the history 260 of a number different end-users to assess trends, similarities of characteristics, etc.

Returning to FIG. 1, the transcription module 136 is configured to apply a selected notation to the musical information 160 to produce one or more transcriptions 150. When a notation 133 is selected, the entire audio signal may be processed according to the characteristics of the notation. For example, and without limitation, an initial musical information 160 corresponding to a sampled portion of the audio signal 125 could be classified using a plurality of notations 133.

In some embodiments, selecting a notation from the plurality of generated notations 133 may include presenting some or all of the notations 133 (e.g., a highest scoring subset of the notations) to an end-user through UI 187, e.g., displaying information related to the different notations using a graphical user interface. The end-user may then manually select one of the notations. In other embodiments, a notation may be selected automatically and without receiving a selection input from the end-user. For example, and without limitation, the notation having the highest score could be selected by the transcription module.

When one of the notations 133 is selected, the musical characteristics of the selected notation (e.g., pitch/frequency and timing information) are applied to classify the musical information 160 corresponding to the full audio signal. In various embodiments, the musical information for the entire audio signal is determined after a notation is selected, which may save processing time and energy. This approach may be useful as the processors 110 may perform significant parallel processing in order to generate the various notations 133 based on the initial (limited) musical information 160. In another embodiment, the musical information 160 for the entire audio signal is determined before or contemporaneously with selection of a notation 133.

The transcription module 136 may output the selected notation as transcription 150 having any suitable format, such as a musical score, chord chart, sheet music, guitar tablature, and so forth. In some embodiments, the transcription 150 may be provided as a digital signal (or file) readable by the computing device 105 and/or other networked computing devices. For example, and without limitation, the transcription 150 could be generated as a file and stored in memory 120. In other embodiments, the transcription 150 may be visually provided to an end-user using display devices 192, which may include visual display devices (e.g., electronic visual displays and/or visual indicators such as light emitting diodes (LEDs)), print devices, and so forth.

In some embodiments, transcriptions 150 and/or the musical information 160 corresponding to the audio signals 125 may be used to generate complementary musical information and/or complementary audio signals 155. In various embodiments, the accompaniment module 138 generates one or more complementary audio signals 155 based on the completed transcription 150. In another embodiment, the accompaniment module 138 generates complementary audio signals 155 based on the musical information 160. In some implementations, discussed in greater detail with respect to FIGS. 7-10 below, the complementary audio signals 155 may be output contemporaneously with receiving the audio signal 125. Because musical compositions generally have some predictability (e.g., a relative consistency of key, rhythm, etc.), the complementary audio signals 155 may be generated as forward-looking (i.e., notes are generated with some amount of time before they are output).

The music information included within complementary audio signals 155 may be selected based on musical compatibility with the musical information 160. Generally, musically compatible properties (in timing, pitch, volume, etc.) are desirable for the contemporaneous output of the complementary audio signals with the audio signals 155. For example, and without limitation, the rhythm of the complementary audio signals 155 could be matched to the rhythm determined for the audio signals 125, such that notes or chords of each signal are synchronized or at least provided with harmonious or predictable timing for a listener. Similarly, the pitch content of the complementary audio signals 155 may be selected based on musical compatibility of the notes, which in some cases is subjective based on cultural preferences. For example, and without limitation, complementary audio signals 155 could include notes forming consonant and/or dissonant harmonies with the musical information included in the received audio signal. Generally, consonant harmonies include notes that complement the harmonic frequencies of other notes, and dissonant harmonies are made up of notes that result in complex interactions (for example and without limitation, beating). Consonant harmonies are generally described as being made up of note intervals of 3, 4, 5, 7, 8, 9, and 12 semitones. Consonant harmonies are sometimes considered to be "pleasant" while dissonant harmonies are considered to be "unpleasant." However, this pleasant/unpleasant classification is a major simplification, as there are times when dissonant harmonies are musically desirable (for example, and without limitation, to evoke a sense of "wanting to resolve" to a consonant harmony). In most forms of music, and in particular, Western popular music, the vast majority of harmony notes are consonant, with dissonant harmonies being generated only under certain conditions where the dissonance serves a musical purpose.

The musical information 160 and/or transcriptions 150 that are determined using certain modules of the computing device 105 may be interfaced with various application modules providing different functionality for end-users. In some embodiments, the application modules may be standalone commercial programs (i.e., music programs) that include functionality provided according to various embodiments described herein. One example of an application module is composition module 140. Similar to the accompaniment module 138, the composition module 140 is configured to generate complementary musical information based on the musical information 160 and/or the transcriptions 150. However, instead of generating a distinct complementary audio signal 155 for output, the composition module 140 operates to provide suggestions or recommendations to an end-user based on the transcription 150. The suggestions may be designed to correct or adjust notes/chords depicted in the transcription 150, add harmony parts for the same instrument, add parts for different instruments, and so forth. This may be particularly useful for a musician who wishes to arrange a musical piece but does not play multiple instruments, or is not particularly knowledgeable in music theory and composition. The end result of the composition module 140 is a modified transcription 150, such as a musical score having greater harmonic depth and/or including additional instrument parts than the part(s) provided in the audio signals 125.

Another example application module is instruction module 142, such as training an end-user how to play a musical instrument or how to score a musical composition. The audio signal 125 may represent the end-user's attempt to play a prescribed lesson or a musical piece on the instrument, and the corresponding musical information 160 and/or transcriptions 150 may be used to assess the end-user's learning progress and adaptively update the training program. For example, and without limitation, the instruction module 142 could perform a number of functions, such as determining a similarity of the audio signal 125 to the prescribed lesson/music, using the musical information 160 to identify specific competencies and/or deficiencies of the end-user, and so forth.

Another example application module is gaming module 144. In some embodiments, gaming module 144 may be integrated with an instruction module 142, to provide a more engaging learning environment for an end-user. In other embodiments, the gaming module 144 may be provided without a specific instruction module functionality. The gaming module 144 may be used to assess a similarity of the audio signal 125 to prescribed sheet music or a musical piece, to determine harmonic compatibility of the audio signal 125 with a musical piece, to perform a quantitative or qualitative analysis of the audio signal itself, and so forth.

Figure 3:
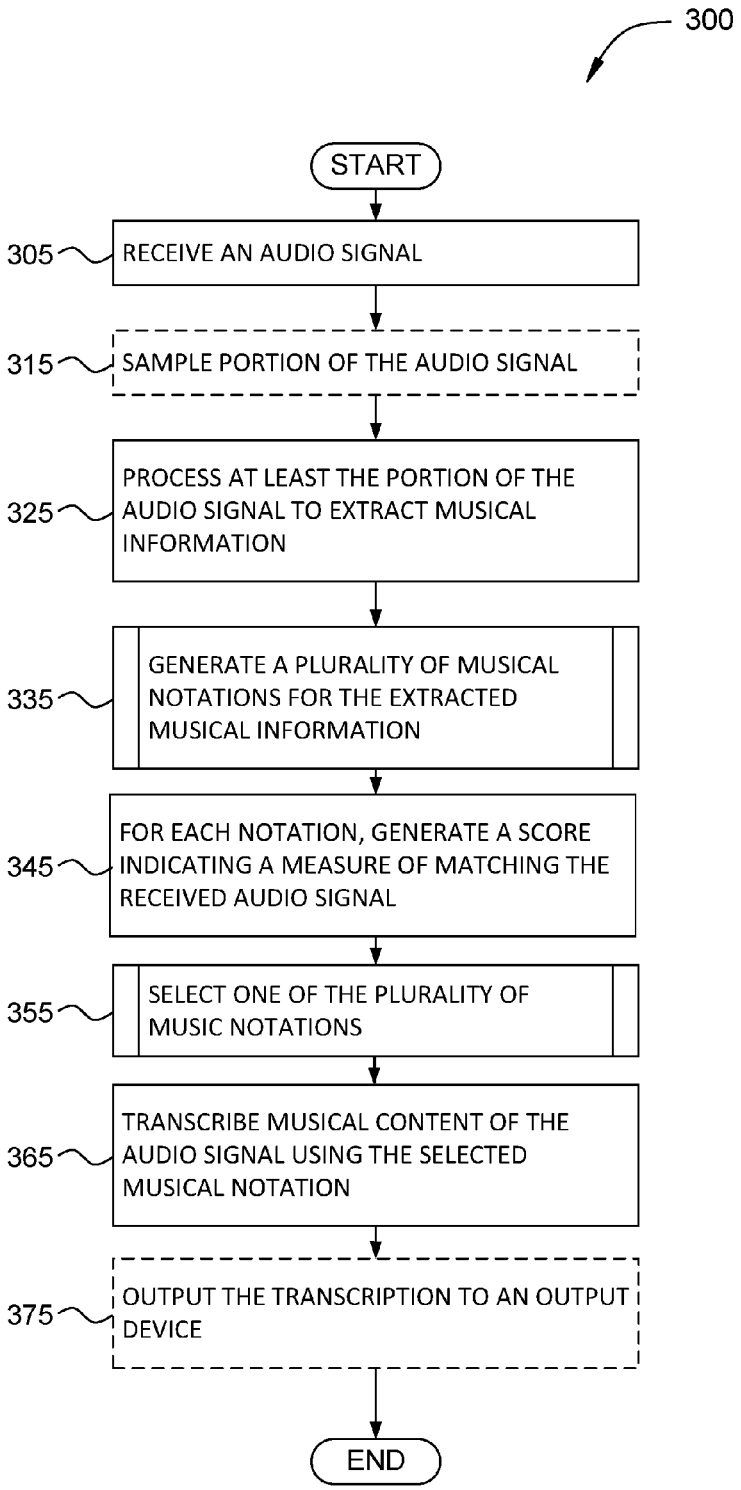
FIG. 3 is a flow diagram of method steps for performing automatic transcription of musical content included in an audio signal, according to various embodiments.

FIG. 3 is a flow diagram of method steps for performing automatic transcription of musical content included in an audio signal, according to various embodiments. Method 300 may be used in conjunction with the various embodiments described herein, such as a part of system 100 and using one or more of the functional modules included in memory 120.

Method 300 begins at block 305, where an audio signal is received by a computing device. The audio signal generally includes musical content, and may be provided in any suitable form, whether digital or analog. Optionally, in block 315, a portion of the audio signal is sampled. In some embodiments, a plurality of audio signals are received contemporaneously. The separate audio signals may represent different parts of a musical composition, such as an end-user playing an instrument and singing, etc.

In block 325, the computing device processes at least the portion of the audio signal to extract musical information. Some examples of the extracted information include note onsets, audio levels, polyphonic note detections, and so forth. In various embodiments, the extracted musical information corresponds only to the portion of the audio signal. In another embodiment, the extracted musical information corresponds to the entire audio signal.

In block 335, the computing device generates a plurality of musical notations for the extracted musical information. The notations provide alternative interpretations of the extracted musical information, each notation generally including a plurality of musical characteristics, such as time signature, key signature, tempo, notes, chords, rhythm types. The notations may share a set of characteristics, and in some embodiments the values for certain shared characteristics may differ between notations, such that the different notations are distinguishable for an end-user.

In block 345, the computing device generates a score for each of the musical notations. The score is generally based on the degree to which the notation matches the audio signal. Scoring may also be performed based on a specified genre of music and/or one or more user profiles corresponding to end-users of the computing device.

In block 355, one of the plurality of musical notations is selected. In various embodiments, the selection occurs automatically by the computing device, such as selecting the notation corresponding to the greatest calculated score. In other embodiments, two or more musical notations are presented to an end-user for receiving selection input through a user interface. In various embodiments, a subset of the plurality of musical notations is presented to the end-user, such as a particular number of notations having the corresponding greatest calculated scores.

In block 365, the musical content of the audio signal is transcribed using the selected musical notation. The transcription may be in any suitable format, digital or analog, visual or computer-readable, etc. The transcription may be provided as a musical score, chord chart, guitar tablature, or any alternative suitable musical representation.

In block 375, the transcription is output to an output device. In various embodiments, the transcription is visually displayed to an end-user using an electronic display device. In another embodiment, the transcription may be printed (using a printer device) on paper or another suitable medium for use by the end-user.

Figure 4A:
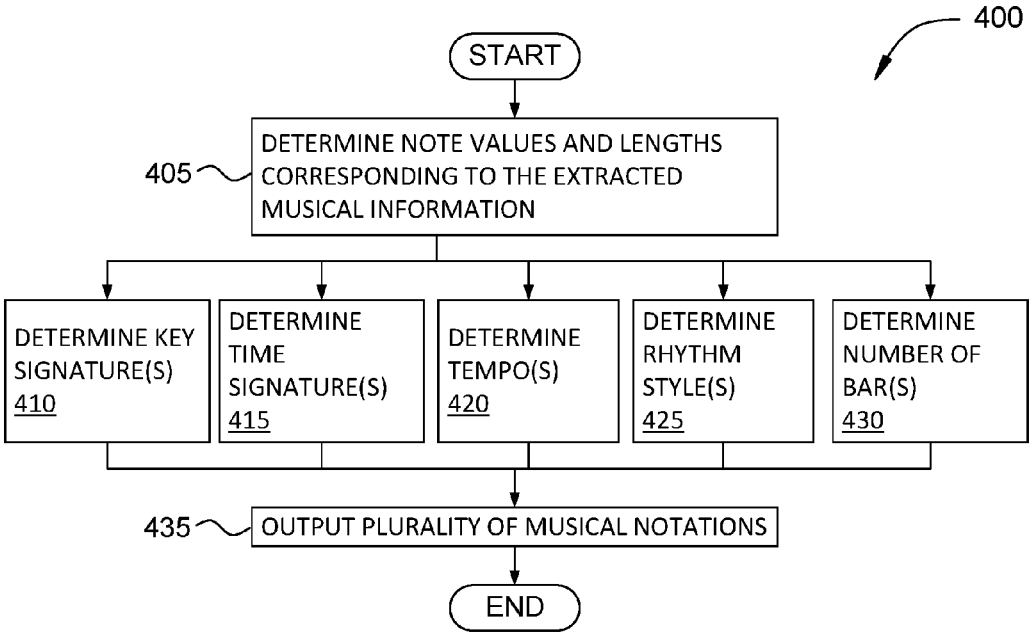
FIG. 4A is a flow diagram of method steps for generating a plurality of musical notations for extracted musical information, according to various embodiments.

FIG. 4A is a flow diagram of method steps for generating a plurality of musical notations for extracted musical information, according to various embodiments. The method 400 generally corresponds to block 335 of method 300, and may be used in conjunction with the various embodiments described herein.

At block 405, the computing device determines note values and lengths corresponding to the extracted musical information. The determination is based on the extracted musical information, which may include determined note onsets, audio levels, polyphonic note detection, and so forth. The determination may include classifying notes by pitch and/or duration using a system of baseline notation rules. For example, and without limitation, according to the staff notation commonly used today, note pitches could be classified from A through G and modified with accidentals, and note lengths could be classified relative to other notes and relative to tempo, time signature, etc. Of course, alternative musical notation systems may be prevalent in other cultures, and such an alternative system may accordingly dictate the baseline classification rules.

At blocks 410-430, the computing device determines various characteristics based on the note information determined in block 405. At block 410, one or more key signatures are determined. At block 415, one or more time signatures are determined. At block 420, one or more tempos are determined. At block 425, one or more rhythm styles or "feels" are determined. At block 430, a number of bars corresponding to the note information is determined. The blocks 410-430 may be determined in a sequence or substantially simultaneously. In various embodiments, a value selected corresponding to one block may affect values of other blocks. For example, and without limitation, time signature, tempo, and note lengths could be all interrelated, such that adjusting one of these properties leads to an adjustment to at least one other to accurately reflect the musical content. In another example, and without limitation, the number of bars could be determined based on one or more of the time signature, tempo, and note lengths.

At block 435, the computing device outputs a plurality of musical notations for the extracted musical information. The plurality of musical notations may include various combinations of the characteristics determined above.

Figure 4B:
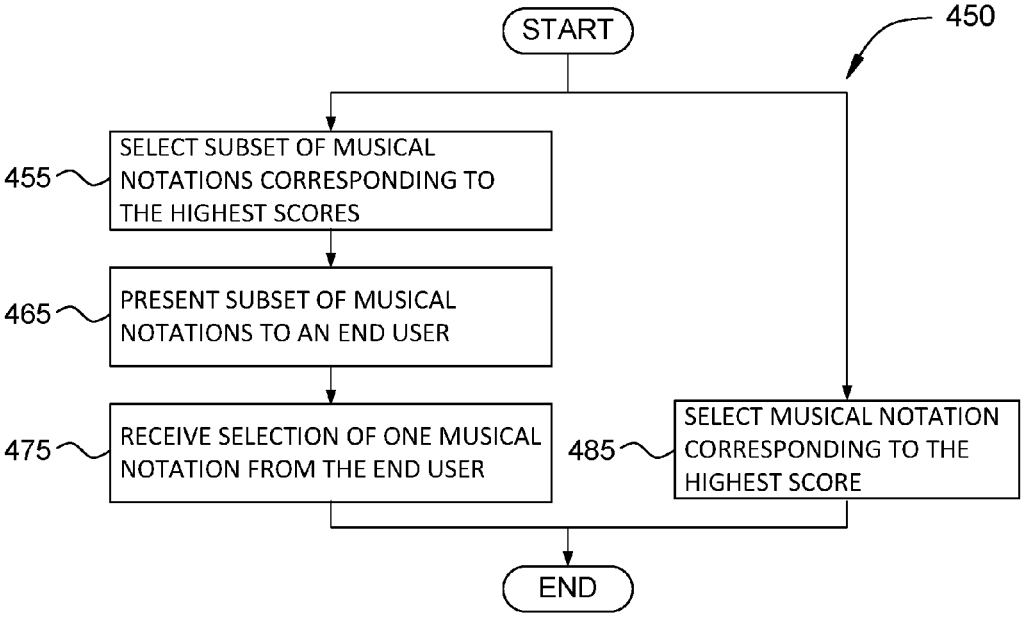
FIG. 4B is a flow diagram of method steps for performing selection of one of a plurality of musical notations, according to various embodiments.

FIG. 4B is a flow diagram of method steps for performing selection of one of a plurality of musical notations, according to various embodiments. The method 450 generally corresponds to block 355 of method 300, and may be used in conjunction with the various embodiments described herein.

At block 455, the computing device selects a subset of musical notations corresponding to the highest calculated scores. In some embodiments, the subset is limited to a predetermined number of notations (e.g., two, three, four, etc.) which may be based on readability of the displayed notations for an end-user. In another embodiment, the subset is limited to all notations exceeding a particular threshold value.

At block 465, the subset of musical notations is presented to the end-user. In various embodiments, this may be performed using an electronic display (e.g., displaying information for each of the subset on the display). In another embodiment, the musical notations are provided via visual indicators, such as LEDs illuminated to indicate different musical characteristics. At block 475, the computing device receives an end-user selection of one of the musical notations. In several embodiments, the selection input may be provided through the user interface, such as a graphical user interface.

As an alternative to the method branch through blocks 455-475, in block 485 the computing device may automatically select a musical notation corresponding to the highest calculated score.

Figure 5A:
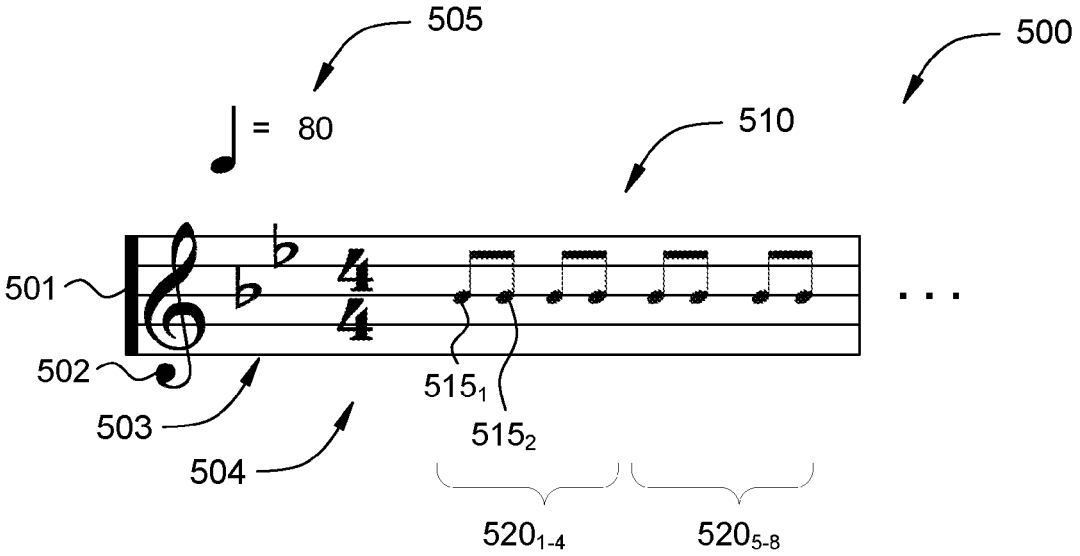
FIGS. 5A and 5B each illustrate alternative musical notations corresponding to the same musical information, according to various embodiments.
Figure 5A:
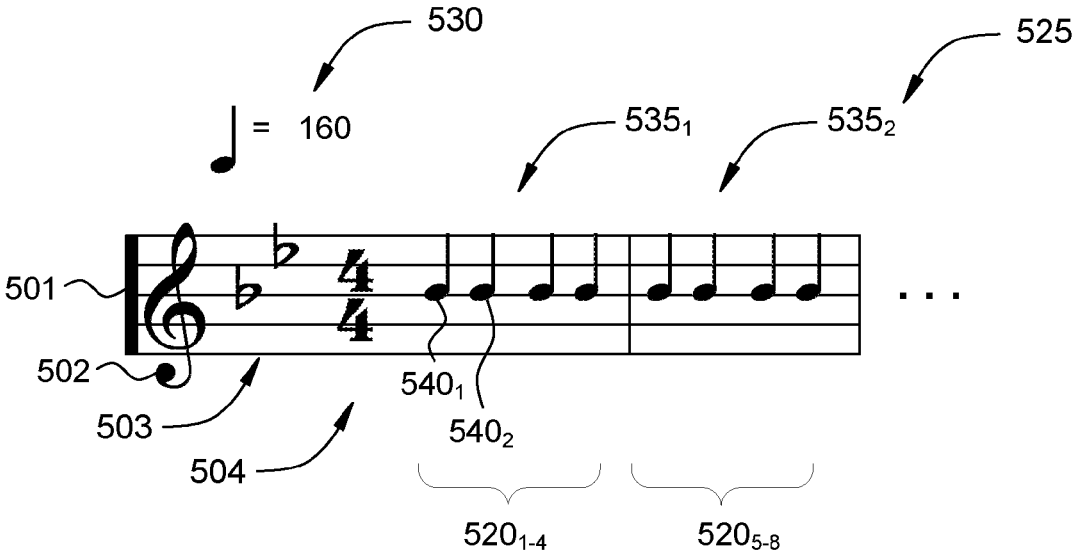
Figure 5B:
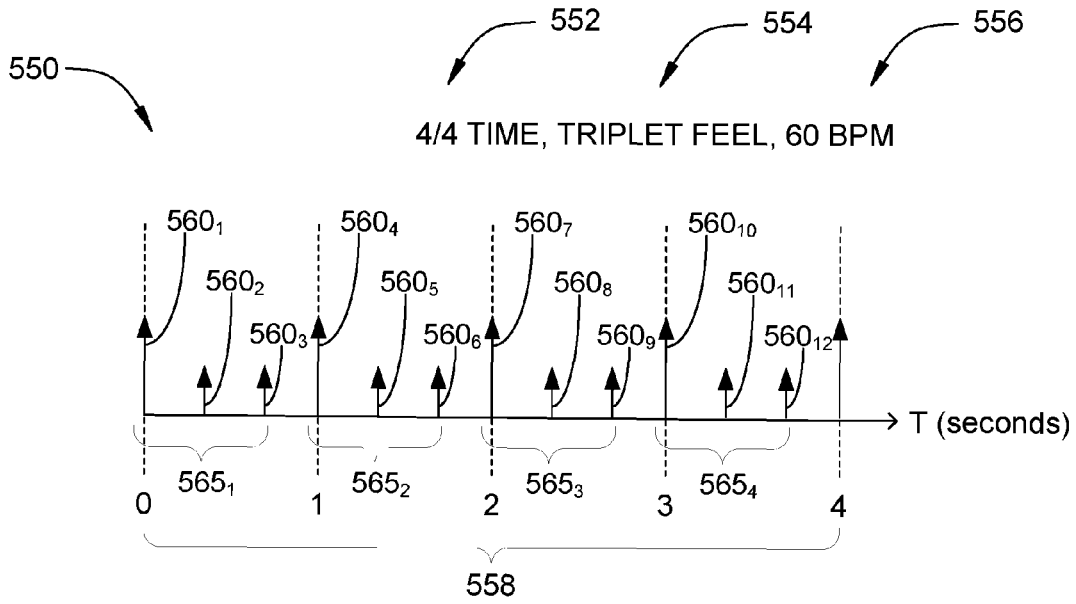
Figure 5B:
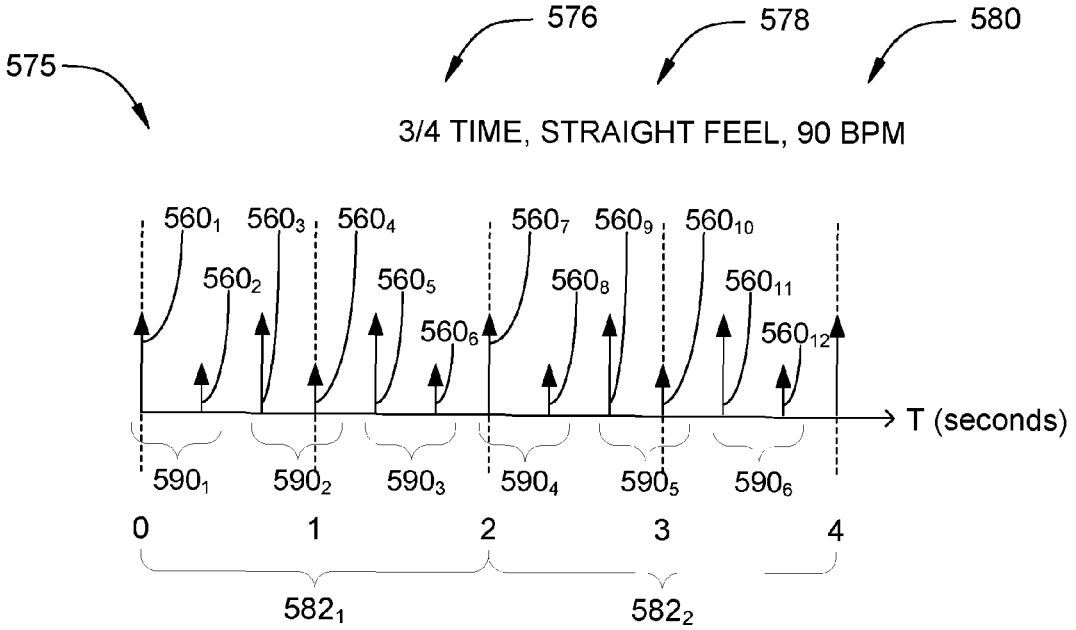

FIGS. 5A and 5B each illustrate alternative musical notations corresponding to the same musical information, according to various embodiments. FIG. 5A illustrates a first set of notes $\mathbf{520}_{1\text{-}8}$. For simplicity of the example, assume that each of the notes 520 corresponds substantially to the same frequency/pitch (here, "B flat" or "Bb") and has substantially the same length.

Notation 500 includes a staff 501, clef 502, key signature 503, time signature 504, and tempo 505, each of which is known to a person of ordinary skill in the art. Measure 510 includes the notes $\mathbf{520}_{1\text{-}8}$, which based on the time signature 504 and tempo 505 are displayed as eighth notes $\mathbf{515}_1$, $\mathbf{515}_2$, etc.

Notation 525 includes the same key signature 503 and time signature 504. However, the tempo 530 differs from tempo 505, indicating that 160 quarter notes should be played per minute (160 beats per minute (bpm), with one quarter note receiving one beat). Tempo 505, on the other hand, indicates 80 bpm. Accordingly, the notes 520 are displayed with different lengths in notation 525—quarter notes $\mathbf{540}_1$, $\mathbf{540}_2$, and so forth. In notation 525, the notes 520 are also divided into two bars or measures $\mathbf{535}_1$ (for notes $\mathbf{520}_{1\text{-}4}$) and $\mathbf{535}_2$ (for notes $\mathbf{520}_{5\text{-}8}$), as there can only be four quarter notes included per measure in a 4/4 song. Since tempo 530 has been increased to 160 bpm from the 80 bpm of tempo 505, this means that the length of the quarter notes has been cut in half, so that the eight quarter notes depicted in notation 525 represent the same length of time as the eight eighth notes depicted in notation 500.

Notations 500 and 525 display essentially the same extracted musical information (notes $\mathbf{520}_{1\text{-}8}$); however, the notations differ in the tempo and note lengths. In alternative embodiments, the notations may include qualitative tempo indicators (e.g., adagio, allegro, presto) that correspond to certain bpm values. Of course, a number of alternative notations may be provided by adjusting time signatures (say, two beats per measure, or a half note receiving one beat) and note lengths. And while not depicted here, pitch properties for the notes may be depicted differently (e.g., D# or Eb), or a different key based on the same key signature (e.g., Bb major or G minor).

FIG. 5B illustrates notations 550, 575 corresponding to alternative musical interpretations of a second set of notes $\mathbf{560}_{1\text{-}12}$. To highlight the timing aspects of musical interpretations, the notations 550, 575 are presented in a different style of transcription than the notations of FIG. 5A (e.g., without note pitch/frequency information depicted).

Notation 550 includes a time signature (i.e., 4/4 time 552), a feel (i.e., triplet feel 554), and a tempo (i.e., 60 bpm 556). Based on these characteristics, the notation 550 groups the notes $\mathbf{560}_{1\text{-}12}$ as triplets $\mathbf{565}_{1\text{-}4}$ within a single measure or bar 558, and relative to a time axis. Each triplet 565 also includes one triplet eighth note that corresponds to a major beat (i.e., $\mathbf{560}_1$, $\mathbf{560}_4$, $\mathbf{560}_7$, $\mathbf{560}_{10}$) within the bar 558.

Next, notation 575 includes a time signature (i.e., 3/4 time 576), a feel (i.e., straight feel 578), and a tempo (i.e., 90 bpm 580). Based on these characteristics, notation 575 groups the notes $\mathbf{560}_{1\text{-}12}$ into eighth note pairs $\mathbf{590}_{1\text{-}6}$ across two measures or bars $\mathbf{582}_1$, $\mathbf{582}_2$. Each eighth note pair 590 also includes one eighth note that corresponds to a major beat (i.e., $\mathbf{560}_1$, $\mathbf{560}_3$, $\mathbf{560}_5$, . . . , $\mathbf{560}_{11}$) within the bars 582.

As in FIG. 5A, the notations 550 and 575 provide alternative interpretations of essentially the same musical information (i.e., notes $\mathbf{560}_{1\text{-}12}$). Using only note onset timing information, a single "correct" interpretation of the notes $\mathbf{560}_{1\text{-}12}$ may be difficult to identify. However, the differences in the interpretations of the notes result in differences in numbers of bars, as well as the timing of major beats within those bars. The person of ordinary skill will appreciate that such differences in alternative notations may have an appreciable impact on the transcription of the musical content included in an audio signal, as well as on the generation of suitable real-time musical accompaniment, which is described in greater detail below. For example, and without limitation, a musician playing a piece of music (e.g., reproducing the musical content included in the audio signal, or playing an accompaniment part generated based on the musical content) that is interpreted according to notation 550 would play in a manner that is completely stylistically different than a piece of music interpreted according to notation 575.

While the examples provided here are relatively simple, the person of ordinary skill will also recognize that a plurality of notations could vary by a number of different musical characteristics, for example, and without limitation, a combination of different tempos and swing indicators, as well as pitch-based characteristics. And while the notations shown depict the musical notes objectively and accurately, an end-user may explicitly prefer (or at least would select) one of the notations for transcribing the musical content of the audio signal. Therefore, these multiple competing alternative notations may be beneficially generated in order to accommodate intangible or subjective factors, such as conscious or unconscious end-user preferences.

Figure 6:
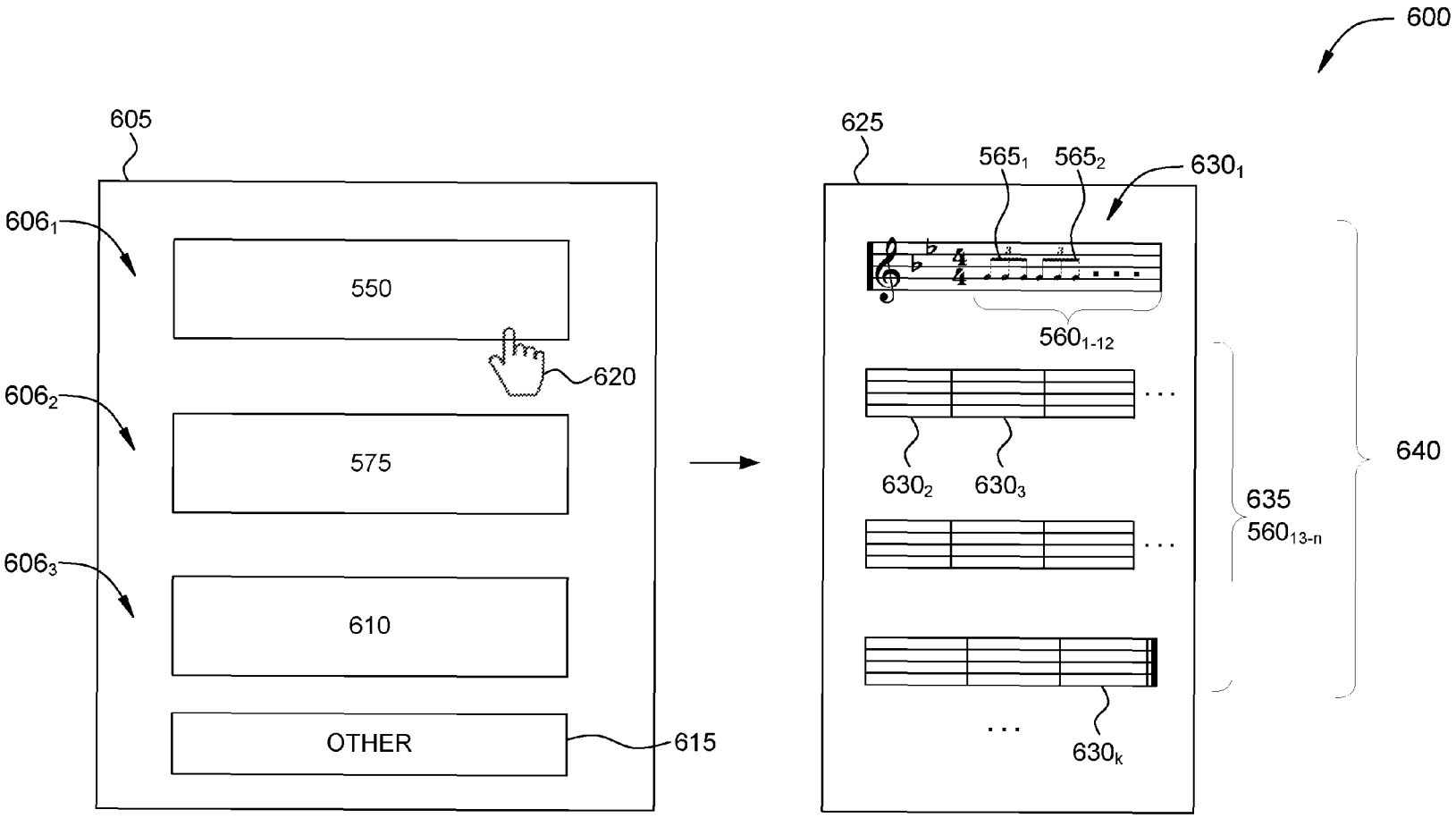
FIG. 6 illustrates selection of a musical notation and transcription using the selected musical notation, according to various embodiments.

FIG. 6 illustrates selection of a musical notation and transcription using the selected musical notation, according to various embodiments. The display arrangement 600 may represent a display screen 605 of an electronic display device at a first time and a display screen 625 at a second time. The display screens 605, 625 include elements of a UI such as the UI 187.

Display screen 605 includes a number of notations 550, 575, and 610 corresponding to the notes $\mathbf{560}_{1\text{-}12}$ described above in FIG. 5B, each notation displayed in a separate portion of the display screen 605. The notations may be displayed on the display screen in the transcription format (e.g., as the notations 550 and 575 appear in FIG. 5B) and/or may include information listed about the notation's musical characteristics (e.g., key of Bb major, 4/4 straight time, 160 bpm, and so forth).

The notations may be displayed in predetermined positions and/or ordered. In various embodiments, the notations are ordered according to the calculated score (i.e., notation 550 has the greatest score and corresponds to position $\mathbf{606}_1$), with decreasing scores corresponding to positions $\mathbf{606}_2$ and $\mathbf{606}_3$.

Display screen 605 also includes an area 615 ("Other") that an end-user may select to specify another notation for the audio signal. The end-user input may be selecting an entirely different generated notation (such as one not ranked and currently displayed on display screen 605) and/or may include one or more discrete changes specified by the end-user to a generated notation.

Upon selection of a notation, the computing device uses information about the selected notation to generate the transcription of the full audio signal. As shown, a user hand 620 selects notation 550 on display screen 605. Display screen 625 shows a transcription 640 of the audio signal according to the notation 550. In various embodiments, the notes $\mathbf{560}_{1\text{-}12}$ that were displayed for end-user selection have already been transcribed as measure $\mathbf{630}_1$ according to the selected notation, and the computing device transcribes the portion 635 of transcription 640 corresponding to notes $\mathbf{560}_{13\text{-}n}$ (not shown but included in measures $\mathbf{630}_2\text{-}\mathbf{630}_k$) after selection of the notation. While a sheet music format shown for the transcription 640, alternative transcriptions are possible. Additionally, the transcription 640 may include information regarding the dynamic content of the audio signal (e.g., volume changes, accents, etc.).

Generation of Real-Time Musical Accompaniment

Several embodiments are directed to performing real-time accompaniment for musical content included in an audio signal received by a computing device. A musician who wishes to create a musical accompaniment signal suitable for output with an instrument signal (e.g., played by the musician) may train an auto-accompaniment system using the instrument signal. However, with prior approaches, the musician typically waits a significant amount of time for completion of the processing before the accompaniment signal is suitable for playback, which causes an interruption in the performance of the instrument, if the process is not altogether asynchronous.

Auto-accompaniment devices may operate by receiving a form of audio signal or derivative signal, such as a MIDI signal, within a learning phase. In order to determine the most appropriate musical properties of the accompaniment signal (based on key, chord structure, number of bars, time signature, tempo, feel, etc.), a fairly complex post-processing analysis occurs after the musician indicates the learning phase is complete (e.g., at the end of a song part). This post-processing typically consumes a significant amount of time, even on very fast modern signal processing devices.

Figure 7:
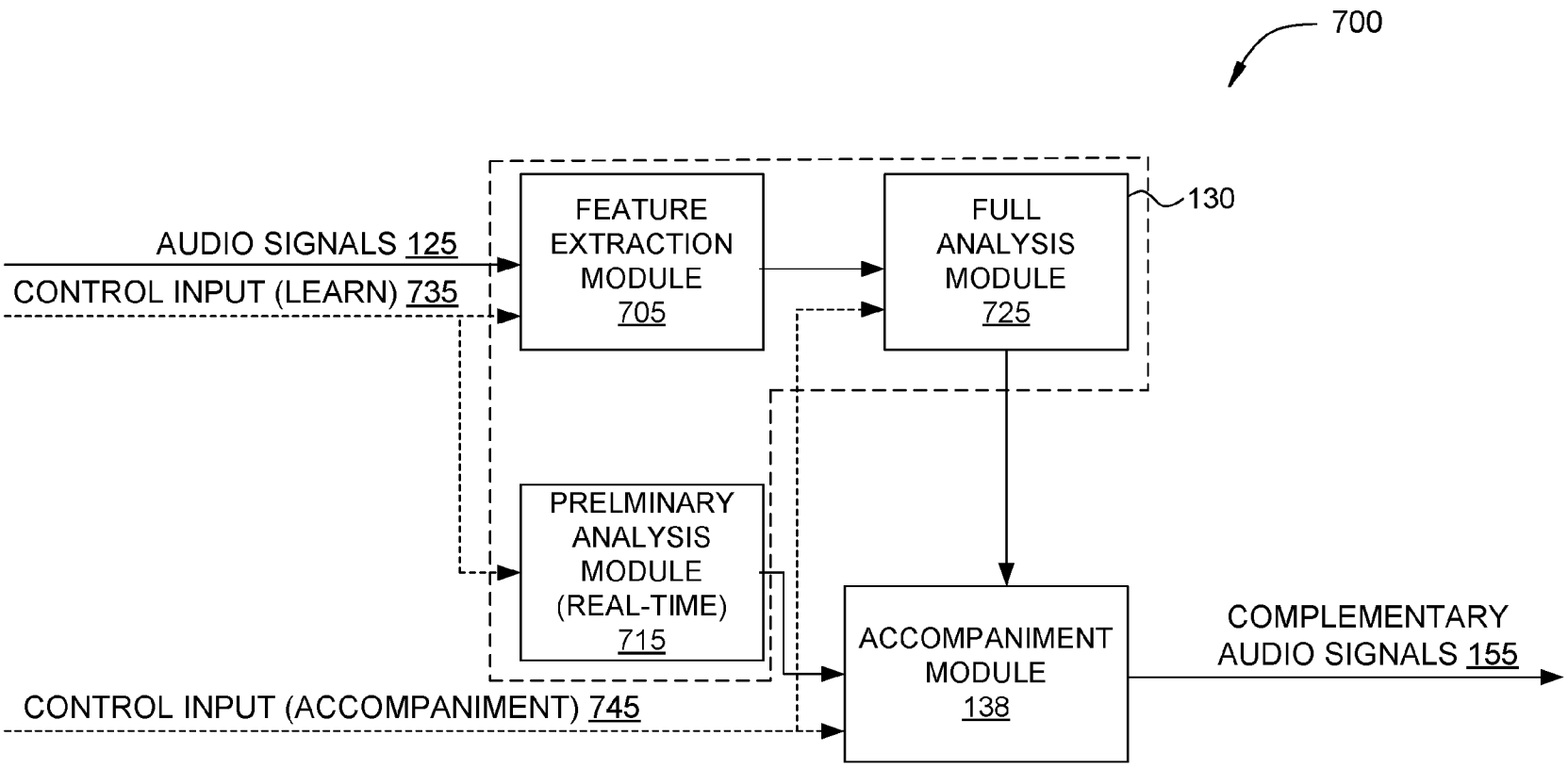
FIG. 7 illustrates an exemplary system for performing real-time musical accompaniment for musical content included in a received audio signal, according to various embodiments.

FIG. 7 illustrates an exemplary system for performing real-time musical accompaniment for musical content included in a received audio signal, according to various embodiments. In some implementations, system 700 may be included within system 100 described herein. For example, and without limitation, the extraction module 130 and accompaniment module 138 of FIG. 7 could be the extraction module 130 and accompaniment module 138 as described in conjunction with FIG. 1.

System 700 is configured to receive, as one input, an audio signal 125 containing musical content. In some embodiments, the audio signal 125 may be produced by operating a musical instrument, such as a guitar. In other embodiments, the audio signal 125 may be in the form of a derivative audio signal, for example, and without limitation, an output from a MIDI-based keyboard.

System 700 is further configured to receive one or more control inputs 735, 745. The control inputs 735, 745 generally cause the system 700 to operate in different modes. As shown, control input 735 corresponds to a "learning" mode of the system 700, and control input 745 corresponds to an "accompaniment" mode. In various embodiments, the system 700 during operation generally operates in a selected one of the available modes. Generally, the learning mode of operation is performed to analyze an audio signal before a suitable complementary audio signal is generated in the accompaniment mode. In various embodiments, an end-user may control the control inputs 735—and thus the operation of the system 700—using passive devices (e.g., one or more electrical switches) or active devices (e.g., through a graphical user interface of an electronic display device) associated with the UI of the system.

During operation, the audio signal 125 is received by a feature extraction module 705 of the extraction module 130, which is generally configured to perform real-time musical feature extraction of the audio signal. Real-time analysis may also be performed using the preliminary analysis module 715, discussed below. Many musical features may be used in the process of performing a more comprehensive musical information analysis, such as note onsets, audio levels, polyphonic note detections, etc. In various embodiments, the feature extraction module 705 may perform real-time extraction substantially continuously for received audio signals. In various embodiments, real-time extraction is performed irrespective of the states of the control input(s). The system 700 may use the feature extraction module 705 to extract useful information from the audio signal 125 even absent an end-user's explicit instructions (as evidenced by the control inputs). In this way, any events that happen prior to an end-user-indicated start time (i.e., at beginning of the learning mode) can be captured. In various embodiments, the feature extraction module 705 operates on received audio signals prior to operation of the system 700 in the learning mode.

During operation, an end-user may operate the UI to instruct the system 700 to transition into learning mode. For example, and without limitation, to transition to learning mode, the end-user could operate a switch, such as a footswitch of a guitar pedal, or make a selection using a GUI. In some embodiments, the system 700 may be configured to "auto-arm" such that the feature extraction module 705 enters the learning mode automatically upon detecting a first note onset of a received audio signal.

Upon entering the learning mode, the system may operate the preliminary analysis module 715, which is configured to perform a limited analysis of the audio signal 125 in real-time. An example of the limited analysis includes determining a key of the musical content of the audio signal. Of course, additional or alternative analysis may be performed—generally with respect to pitch and/or timing information—but the analysis may determine only a limited set of characteristics so that the analysis may be completed substantially in real-time (in other words, without an appreciable delay, and able to process portions of the audio signal as they are received). In various embodiments, the preliminary analysis module 715 also determines an intended first musical chord corresponding to the audio signal 125.

In various embodiments, am end-user plays a musical instrument (e.g., a guitar) to provide the audio signal 125. To indicate that a musical phrase in the audio signal 125 should be learned, the musician may step on a footswitch or provide an alternate indication that the musical phrase is beginning about the time that the first notes are played. The musician plays the musical phrase having a particular time signature (e.g., 3/4 or 4/4) and a particular feel (e.g., straight or swing), with the associated chords optionally changing at various points during the phrase. After the performance of a certain amount of a musical song, such as completing a musical phrase, the end-user may indicate completion of the learning phase and beginning of the accompaniment phase. The performed amount contained in the audio signal 125 may reflect any amount of the song desired by the end-user, but in some cases an end-user may directly provide the transition indication at the end of a particular section, phrase, or other subdivision of the song, e.g., before repeating the section or phrase, or before beginning another section or phrase. In various embodiments, the end-user operates a footswitch to provide the appropriate control input 745 to the system to indicate that accompaniment should begin. The beginning of the section or phrase could also be indicated by instructing (i.e., "arming") the algorithm to listen for the instrument signal to cross a certain energy level rather than using a separate indication. In various embodiments, a more accurate location for the start and end of the musical phrase may be determined by searching for a closest note onset within a range (e.g., +/−100 ms) of the start and end indicated by the end-user.

In various embodiments, accompaniment module 138 transmits one or more complementary audio signals 155 substantially immediately when the end-user provides the indication to transition to the accompaniment mode. "Substantially immediately" is generally defined based on the end-user's perception of the relative timing of the audio signal and the complementary audio signal 155. In various embodiments, "substantially immediately" includes outputting the complementary audio signal prior to or at the same time as a next beat within the audio signal. In various embodiments, "substantially immediately" includes outputting the complementary audio signal prior to or at the same time as a fraction of beat within the audio signal, for example, and without limitation, a half beat, a quarter beat, or an eight beat. In various embodiments, "substantially immediately" includes outputting the complementary audio signal within an amount of time that is audibly imperceptible for the end-user, such as within 40 ms or less. By beginning output of the accompaniment signals "substantially immediately," the system 700 gives an end-user the impression that the operation of the footswitch or other UI element has triggered an immediate accompaniment. This impression may be particularly important to end-users, who would prefer a continuous, uninterrupted musical performance instead of the disruption caused by stopping for completion of processing, and restarting when the accompaniment signal has been generated.

In some embodiments, the initial portion of the complementary audio signals, which are output "substantially immediately," corresponds to the limited preliminary analysis of the audio signal performed by preliminary analysis module 715. Accordingly, those initial portions of the complementary audio signals 155 may be generated with less musical complexity than later portions that are produced after a full analysis is completed on the received audio signal. In various embodiments, a single note or chord is produced and output for the initial portion of the complementary audio signals 155, and which note or chord may or may not be held until completion of the full analysis of the audio signal. In various embodiments, the initial portion of the complementary audio signal is based on one of a determined key and a determined first chord of the audio signal.

The complementary audio signals 155 may be generated corresponding to one or more distinct instrument parts. In various embodiments, the accompaniment module 138 outputs the complementary audio signal for the same instrument(s) used to produce the audio signal 125. For example, and without limitation, for an input signal from a guitar, the output complementary audio signal could correspond to a guitar part. In some embodiments, the accompaniment module 138 outputs complementary audio signals 155 for one or more different instruments. In various embodiments, the complementary audio signals 155 may be the audio signal 125, or a complementary audio signal for the same instrument(s) used to produce the audio signal 125, mixed with complementary audio signals 155 for one or more different instruments. For example, and without limitation, an input guitar signal could correspond to complementary audio signals generated for a bass guitar and/or a drum set. The complementary audio signals 155 could be the audio signals generated for the bass guitar and/or the drum set. In the alternative, the complementary audio signals 155 could be the audio signals generated for the bass guitar and/or the drum set mixed with either the input guitar signal or a complementary audio signal for the same type of guitar used to guitar input signal. In this way, the system 700 may be used to effectively turn a single musician into a "one-man band" having several instrument parts. Additionally, the real-time accompaniment aspects make system 700 suitable for use in live musical performance or recording. The adaptive nature of the feature extraction and real-time accompaniment also makes system 700 suitable for musical performance that includes improvisation, which may be common within certain styles or genres of performed music such as jazz, blues, etc.

Beyond triggering the output of complementary audio signals 155, the end-user's indication to transition into accompaniment mode may also signal to the full analysis module 725 of the system 700 to begin a more complete analysis of the audio signal 125 in order to produce subsequent portions of the complementary audio signal that are more musically complex and that follow the initial portion of the complementary audio signal. For example, and without limitation, the full analysis module 725 could analyze the features extracted within the learning mode to determine a number of parameters needed to produce suitable complementary audio signals. Examples of determined parameters include, without limitation: a length of the song section or part, a number of bars or measures, a chord progression, a number of beats per measure, a tempo, and a type of rhythm or feel (e.g., straight or swing time).

In some embodiments, using efficient programming techniques (such as dynamic programming) on modern processors, the full analysis module 725 may complete a complete analysis of the extracted features before the next major beat within the audio signal occurs. In that way, subsequent portions may begin with the next major beat of the audio signal, giving the end-user an impression of continuous musical flow between learning mode and accompaniment mode. Even where additional time is needed to complete the processing related to complete analysis of the extracted features, if at least the initial portion of the complementary audio signal begins in sync with the first beat of the audio signal, an end-user may still find this acceptably continuous for musical performance so long as the subsequent portions begin within a reasonably short amount of time. In various embodiments, the first subsequent portion following the initial portion begins corresponding to a subdivision of the musical content of the audio signal, such as synchronized with the next beat, the beginning of the next measure, number of measures, or section, etc.

Figure 8:
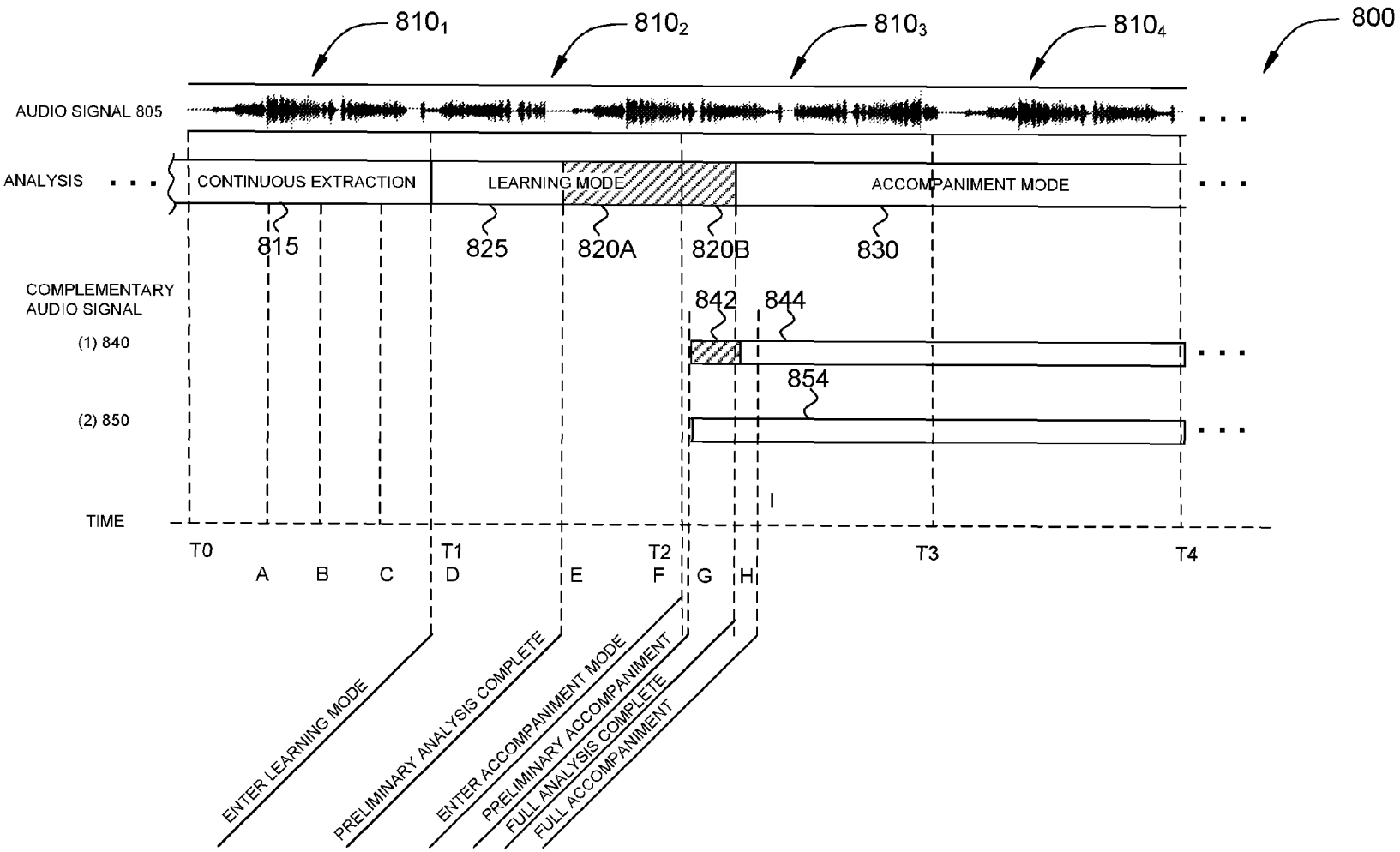
FIG. 8 is a chart illustrating exemplary timing of a system for performing real-time musical accompaniment, according to various embodiments.

FIG. 8 is a chart illustrating exemplary timing of a system for performing real-time musical accompaniment, according to various embodiments. The chart 800 generally corresponds to operation of the system 700 and the description provided thereof.

Chart 800 shows, on a first plot, an audio signal 805. The audio signal may correspond to a guitar part or to another instrument part. The audio signal 805 includes four repeated sections $\mathbf{810}_1$, $\mathbf{810}_2$, $\mathbf{810}_3$, $\mathbf{810}_4$ (i.e., each containing similar musical information, with perhaps minor variability in the audio signal due to human performance, noise, etc.). Each of the sections 810 begins at a respective time $t_0$, $t_1$, $t_2$, $t_3$, which are depicted on a second plot (i.e., Time).

Another included plot, labeled Analysis, provides an overview of the signal processing performed across various modes of the system 700. A first period 815 includes a continuous extraction mode in which a particular set of musical features are extracted from received audio signals. In various embodiments, this mode begins prior to receiving the audio signal 805 (i.e., prior to $t_0$). The set of musical features to be extracted may be limited from a full analysis of the audio signal performed later. Example features extracted during the period 815 include note onsets, audio levels, polyphonic note detection, and so forth. Within period 815, the system 700 may update the extracted features more or less continuously, or may update the features at one or more discrete time intervals (i.e., times A, B, C).

At time D, which corresponds to time $t_1$, an end-user operates an element of the UI to instruct the system 700 to enter learning mode. In various embodiments, this includes the end-user operating an electrical switch (e.g., stepping on a footpedal switch). In another embodiment, this includes selecting the mode using a displayed GUI. The end-user may operate the UI at any time relative to the music of the audio signal, but in some cases may choose to transition modes at a natural transition point (such as between consecutive sections 810).

Responsive to the end-user input, the system enters learning mode and begins a preliminary analysis of the received audio signal during a first subperiod 825 of the period 820A. The preliminary analysis may be performed using the features extracted during the period 815 and may include determining an additional set of features of the music content of audio signal 805. Some examples of determined features from the preliminary analysis include a key of the music content of the audio signal 805, a first chord of the audio signal, a timing of major beats within the audio signal, and so forth. In various embodiments, the set of features determined during preliminary analysis (i.e., subperiod 825) may involve more processing than the set of features determined during period 815. Making a determination of the particular set of features may be completed prior to entering an accompaniment mode 830 (i.e., at a time E). In various embodiments, completion of the preliminary analysis triggers entering the accompaniment mode 830 (i.e., time F). In another embodiment, the system remains in learning mode, awaiting input from an end-user to transition to accompaniment mode 830, and may perform additional processing on the audio signal 805. The additional processing may include updating the set of features determined by the preliminary analysis (continuously or periodically) and/or may include performing a next phase (e.g., corresponding to some or all of the "full analysis," discussed below) of feature determination for the audio signal.

One example method suitable for use in a preliminary analysis of audio signals includes:

First, the system determines the nearest note onset following the time at which the end-user started the learning mode. Next, during a predetermined interval (e.g., an "early" learning phase), the system analyzes detected musical notes and specifically attempts to group the detected notes into chords that have a similar root.

Next, the system applies a second grouping algorithm that combines disjointed chord segments having the same root, even where the chord segments may be separated by other segments. In various embodiments, the other segments may include one or more unstable segments of a relatively short duration.

Next, the system determines whether, during the predetermined interval, a suitably stable chord root was found. If the stable chord root was found, the note may be saved as a possible starting note for complementary audio signals.

If the chord root was not sufficiently stable, the system may continue monitoring the incoming musical notes from the audio signal and use any known techniques to estimate the key of the musical content. The system may use the root note of this estimated key as the starting note for complementary audio signals. The example method ends following this step.

At time F, the system 700 enters the accompaniment mode 830, during which one or more complementary audio signals 840, 850 are generated and/or output to associated audio output devices such as speakers or headphones. The transition of modes may be triggered by an end-user operating an element of the UI, which generally indicates an end of the learning mode to the system 700. An explicit signaling of the end of learning mode allows the system to make an initial estimate of the intended length of the musical performance captured in the audio signal 805. The system may thus generally associate a greater confidence with the musical features determined during the learning mode (or at least the state of the musical features at the time of transition, time F) when compared with earlier times in the analysis where the possibility that the audio signal would include significantly more and/or significantly different musical content to be analyzed was unknown.

Upon entering the accompaniment mode (or alternately, upon terminating the learning mode), the system 700 performs a full analysis of the musical content of the audio signal 805. The full analysis may include determining yet further musical features, so that the amounts of features determined increases for each stage or mode in the sequence (e.g., continuous extraction mode to learning mode to accompaniment mode). In the full analysis, the system may determine a number of musical parameters necessary to produce suitable complementary audio signals. Examples of determined parameters include: a length of the song section or part, a number of bars or measures, a chord progression, a number of beats per measure, a tempo, and a type of rhythm or feel (e.g., straight or swing time). In various embodiments, full analysis begins only after the transition from learning mode into accompaniment mode. In another embodiment, some or all of the feature determination for full analysis begins in the learning mode following completion of the feature determination of the preliminary analysis.

To provide an end-user the impression that operation of the UI element triggers an immediate accompaniment that is suitable for musical performance without interruption, the system may begin output of the complementary audio signal(s) substantially immediately (defined more fully above) at time G upon receiving the input at time F to transition into the accompaniment mode. In various embodiments, the interval between times F and G is audibly imperceptible for the end-user, such as an interval of 40 ms or less.

However, in some cases, the time to complete the full analysis on the audio signal 805 may extend beyond time G. This time is shown as subperiod 820B. In some embodiments, in order to provide the "immediate accompaniment" impression to the end-user despite the full analysis being partially complete, the system 700 generates a initial portion of the complementary audio signal based on the analysis completed (e.g., the preliminary analysis or a completed portion of the full analysis). The initial portion is represented by subperiod 842 of complementary audio signal 840. In various embodiments, the initial portion may include a single note or chord, which in some cases may be held for the length of the subperiod 842.

Upon completion of the full analysis at time H, the system may generate subsequent portion(s) of the complementary audio signal that are based on the full analysis. One subsequent portion is depicted for time subperiod 844 and 854 of complementary audio signal 840 and 850, respectively. Generally, the subsequent portions may be more musically complex than the initial portion because the full musical analysis is available to generate the complementary audio signal. To provide the impression of seamlessness to an end-user, in various embodiments the system 700 may delay output of the subsequent portions of the complementary audio signal to correspond with a next determined subdivision (e.g., a next beat, major beat, measure, phrase, part, etc.) of the audio signal. This determined delay is represented by the time interval between times H and I.

In various embodiments, a plurality of complementary audio signals 840, 850 are generated, each of which may correspond to a different instrument part (such as a bass guitar, or a drum set). In various embodiments, all of the complementary audio signals generated include an initial portion (e.g., simpler than subsequent portions) of the same time length. In other embodiments, however, one or more of the complementary audio signals may have different lengths of initial portions, or some complementary audio signals do not include an initial portion at all. If certain types of analysis of the audio signal 805 differ in complexity or are more or less processor intensive, or if generating certain parts in the complementary audio signal is more or less processor intensive, the system 700 may corresponding prioritize the analysis of the audio signal and/or generation of complementary audio signals. For example, and without limitation, producing a bass guitar part could involve determining correct frequency information (note pitches) as well as timing information (matching the rhythm of the audio signal), while a drum part could involve determining only timing information. Thus, in various embodiments, the system 700 may prioritize determining beats or rhythm within the analysis of the input audio signal, so that even if the processing needed to determine the bass guitar part involves generating an initial, simpler portion (e.g., complementary audio signal 840), the drum part may begin full performance and need not include an initial, simpler portion (e.g., complementary audio signal 850). Such a sequenced or layered introduction of different musical instruments' parts may also enhance the realism or seamless impression to an end-user. In other embodiments, the system 700 may prioritize those parts that involve additional analysis, so that all the musical parts are completed at an earlier time without having staggered introductions. In various embodiments, layered or same-time introduction may be end-user selectable, e.g., through the UI.

Figure 9:
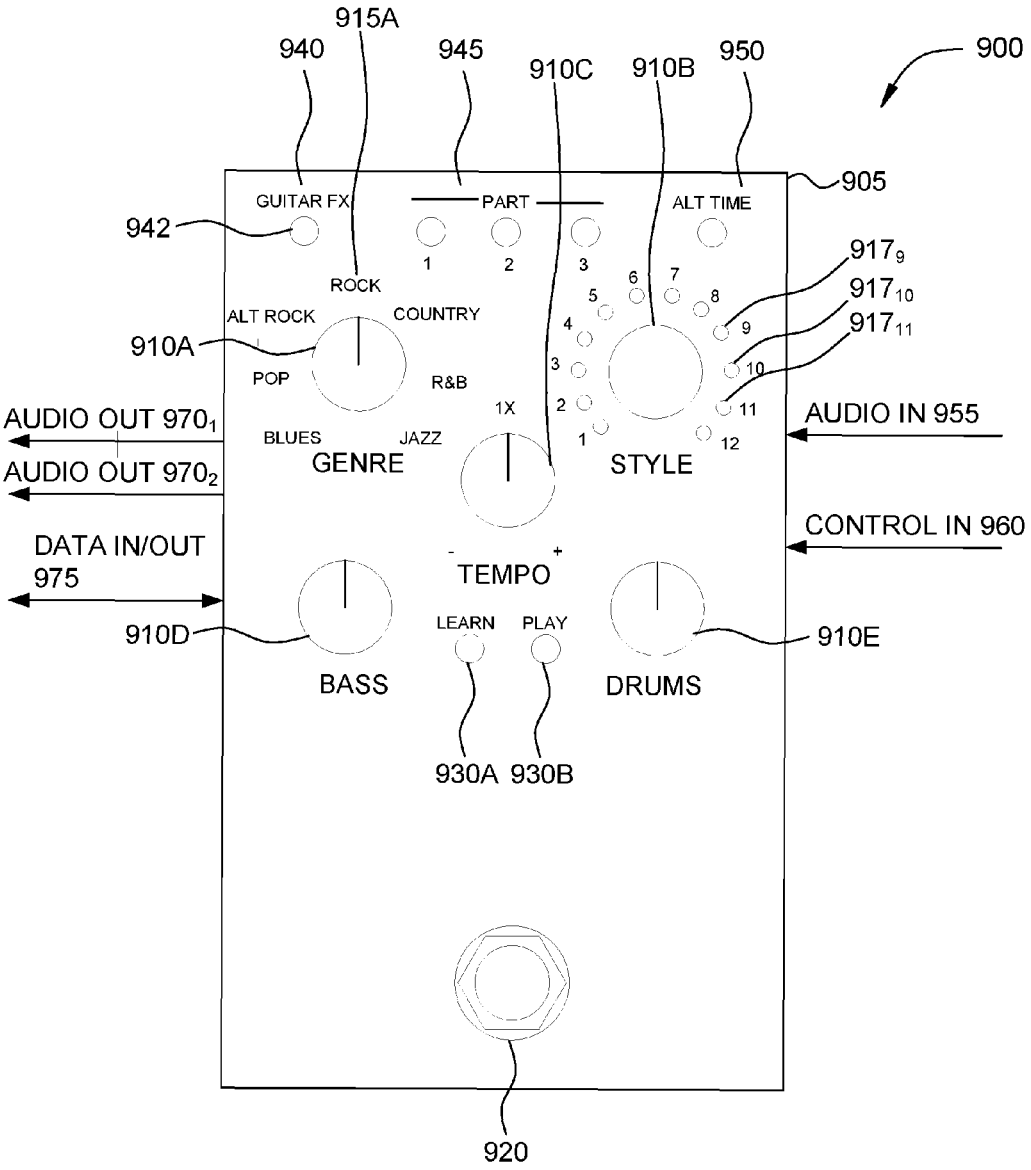
FIG. 9 illustrates an exemplary implementation of a system for performing real-time musical accompaniment, according to various embodiments.

FIG. 9 illustrates an exemplary implementation of a system for performing real-time musical accompaniment, according to various embodiments. The implementation depicts a guitar footpedal 900 having a housing 905 with circuitry enclosed therein. The circuitry may generally correspond to portions of the computing device 105 that are depicted and described for systems 100 and 700 (e.g., including processors 110, memory 120 with various functional modules). For simplicity, portions of the footpedal may not be explicitly depicted or described but would be understood by the person of ordinary skill in the art.

Footpedal 900 supports one or more inputs and one or more outputs to the system. As shown, the housing 905 may include openings to support wired connections through an audio input port 955, a control input port 960, one or more audio output ports $\mathbf{970}_1$, $\mathbf{970}_2$, and a data input/output port 975. In another embodiment, one or more of the ports may include a wireless connection with a computing device, a musical instrument, an audio output device, etc. The audio output ports $\mathbf{970}_1$, $\mathbf{970}_2$ may each provide a separate output audio signal, such as the complementary audio signals generated corresponding to different instrument parts, or perhaps reflecting different processing performed on the same audio signal(s). In various embodiments, the data input/output port 975 may be used to provide automatic transcription of signals received at the audio input port 955.

The housing 905 supports one or more UI elements, such as a plurality of knobs 910, a footswitch 920, and visual indicators 930 such as LEDs. The knobs 910 may each control a separate function of the musical analysis and/or accompaniment. In various embodiments, the genre selection knob 910A allows the user to select the type of accompaniment to match specific musical genres, the style selection knob 910B indicates which styles best match the automatic transcription (for example, and without limitation, using colors or brightness to indicate how well the particular style matches), and the tempo adjustment knob 910C is used to cause the accompaniment being generated to speed up or slow down, for example, and without limitation, to facilitate practicing. The bass (volume) level knob 910D and drum level knob 910E control the level of each instrument in the output mix. Of course, alternative functions may be provided. Knobs 910 may include a selection marker 915 (e.g., selection marker 915A) whose orientation indicates a continuous (bass level knob 910D or drum level knob 910E) or discrete selected position (genre knob 910A). Knobs 910 may also correspond to visual indicators (e.g., indicators $\mathbf{917}_{9\text{-}11}$ are shown), which may be illuminated based on the position or turning of the knob, etc. The colors and/or brightness levels may be variable and can be used to indicate information such as how well as a style matches a learned performance.

The footswitch 920 may be operated to select modes such as a learning mode and an accompaniment mode. In one configuration, the footpedal 900 is powered on and by default enters a continuous extraction mode. An end-user may then press the footswitch 920 a first time to cause the system to enter the learning mode (which may be indicated by illuminating visual indicator 930A), and a second time to cause the system to terminate the learning mode and/or to enter the accompaniment mode (corresponding to visual indicator 930B). Of course, other configurations are possible, such as time-based transitions between modes.

The housing 905 also supports UI elements selecting and/or indicating other functionality, such as pushbutton 942 which in some cases may be illuminated. The pushbutton 942 may be used to select and/or indicate the application of desired audio processing effects using processors 110 to the input signal ("Guitar FX" 940). In various embodiments, pressing the Guitar FX 940 button one time causes the button to illuminate as green and result in effects which are most appropriate for strumming a guitar, and pressing the button again causes the button to illuminate as red and result in effects most appropriate for lead guitar playing. Similar pushbuttons or elements may also be provided to select and/or indicate one or more musical parts 945 (which may be stored in memory 120), as well as an alternate time 950. In various embodiments, the alternate time button 950 may be illuminated such that the alternate time button 950 may flash green at the current tempo setting as determined by the automatic transcription and setting of the tempo knob 910C. When pressed, the indicator can flash red at a tempo that is an alternate tempo that still provides a good match to the automatic transcription, for example, and without limitation, a tempo that is double or half of the original tempo.

Figure 10:
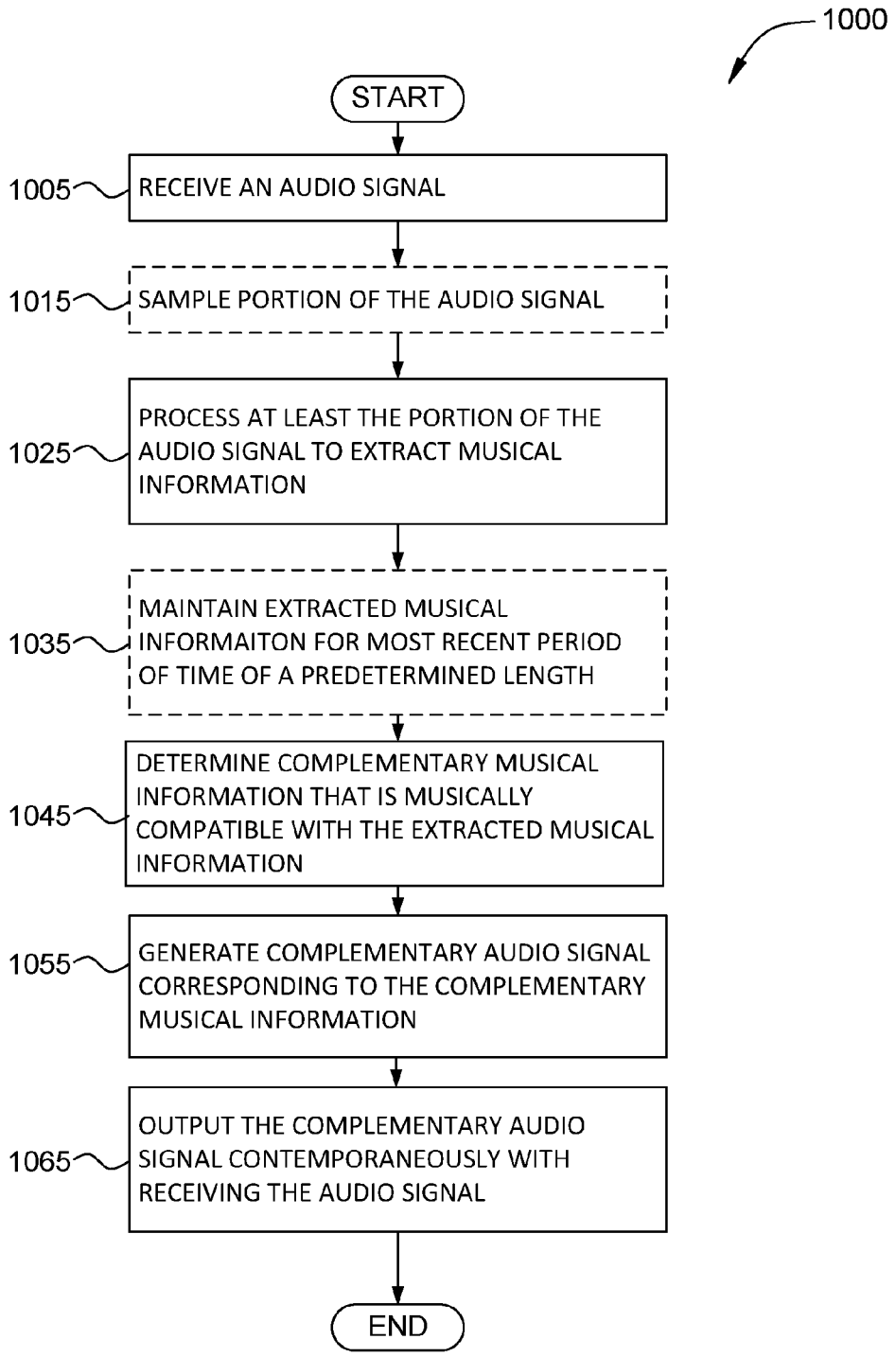
FIG. 10 is a flow diagram of method steps for performing real-time musical accompaniment for musical content included in a received audio signal, according to various embodiments.

FIG. 10 is a flow diagram of method steps for performing real-time musical accompaniment for musical content included in a received audio signal, according to various embodiments. The method 1000 may generally be used with systems 100, 700 and consistent with the description of FIGS. 7-9 described above.

Method 1000 begins at block 1005, where an audio signal is received by a system. The audio signal includes musical content, which may include a vocal signal, an instrument signal, and/or a signal derived from a vocal or instrument signal. The audio signal may be recorded (i.e., received from a memory) or generated live through musical performance. The audio signal may be represented in any suitable format, whether analog or digital.

At block 1015, a portion of the audio signal is optionally sampled. At block 1025, the system processes at least the sampled portion of the audio signal to extract musical information from the corresponding musical content. In various embodiments, the system processes the entire received audio signal. In various embodiments, the processing and extraction of musical information occurs during a plurality of stages or phases, each of which may correspond to a different mode of system operation. In various embodiments, the musical feature set increases in number and/or complexity for each subsequent stage of processing.

At block 1035, the system optionally maintains the extracted musical information for a most recent period of time, which has a predetermined length. Generally, this may correspond to updating the musical information at a predetermined interval. In various embodiments, updating the musical information may include discarding a previous set of extracted musical information.

At block 1045, the system determines complementary musical information that is musically compatible with the extracted musical information, where complementary musical information that is musically compatible includes musical information that has at least one of a rhythmic relationship and a harmonic relationship with the extracted musical information. This step may be performed by an accompaniment module. At block 1055, the system generates one or more complementary audio signals corresponding to the complementary musical information. In various embodiments, the complementary audio signals correspond to different musical instruments, which may differ from the instrument used to produce the received audio signal.

At block 1065, the complementary audio signals are output contemporaneously with receiving the audio signal. Generally, the complementary audio signals are output using audio output devices coupled with the system. The beginning time for the output complementary audio signals may be controlled by an end-user through a UI element of the system. The timing of the complementary audio signals may be determined to provide an impression of a seamless, uninterrupted musical performance for the end-user, who in some cases may be playing a musical instrument corresponding to the received audio signal. In various embodiments, the complementary audio signals include initial portions having a lesser musical complexity and subsequent portions having a greater musical complexity, based on an ongoing completion of processing of the received audio signal. In various embodiments, the output of the complementary audio signals occurs within a short period of time that is audibly imperceptible for an end-user, such as within 40 ms of the indicated beginning time. In various embodiments, the system may delay output of portions of the complementary audio signal to correspond with a determined subdivision of the audio signal, such as a next major beat, a beat, a phrase, a part, and so forth. Method 1000 ends following block 1065.

The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments.

Aspects of the present embodiments may be embodied as a system, method or computer program product. Accordingly, aspects of the present disclosure may take the form of an entirely hardware embodiment, an entirely software embodiment (including firmware, resident software, microcode, etc.) or an embodiment combining software and hardware aspects that may all generally be referred to herein as a "circuit," "module" or "system." Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium could be, for example, and without limitation, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Aspects of the present disclosure are described above with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, enable the implementation of the functions/acts specified in the flowchart and/or block diagram block or blocks. Such processors may be, without limitation, general purpose processors, special-purpose processors, application-specific processors, or field-programmable processors or gate arrays.

The flowchart and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

While the preceding is directed to embodiments of the present disclosure, other and further embodiments of the disclosure may be devised without departing from the basic scope thereof, and the scope thereof is determined by the claims that follow.

What is claimed is:

1. A method for generating an accompaniment for musical content included in a first audio signal, the method comprising:

receiving the first audio signal via an audio input device;

extracting, from the first audio signal, musical information characterizing at least a portion of the musical content;

generating a second audio signal that has at least one of a rhythmic relationship and a harmonic relationship with the musical information; and transmitting, substantially immediately after receiving the first audio signal, the second audio signal to an audio output device;

wherein receiving the first audio signal and extracting the musical information are associated with a learning mode, and generating a second audio signal and transmitting the second audio signal are associated with an accompaniment mode; and wherein, during both the learning mode and the accompaniment mode, the musical information is extracted from the first audio signal substantially continuously.

2. The method of claim 1, wherein receiving the first audio signal comprises receiving a musical phrase associated with the musical content, and transmitting the second audio signal comprises transmitting, substantially immediately after receiving the musical phrase, the second audio signal to the audio output device.

3. The method of claim 1, further comprising:

generating a third audio signal that is more complex than the second audio signal and has at least one of a rhythmic relationship and a harmonic relationship with the musical information;

halting transmission of the second audio signal to the audio output device; and transmitting, substantially immediately after halting transmission of the second audio signal, the third audio signal to the audio output device.

4. The method of claim 1, further comprising updating musical information corresponding to a portion of the first audio signal received in a most recent period of time having a predetermined length.

5. The method of claim 1, wherein the first audio signal includes musical content associated with a first type of musical instrument, and the second audio signal includes second musical content associated with a second type of musical instrument.

6. The method of claim 5, wherein the first type of musical instrument comprises a first stringed instrument, and the second type of musical instrument comprises at least one of a second stringed instrument and a percussive instrument.

7. A non-transitory computer-readable storage medium including instructions that, when executed by a processor, configure the processor to generate accompaniment for musical content included in a received audio signal by performing the steps of:

receiving a first audio signal via an audio input device;

receiving an indication that the first audio signal has been received;

extracting, from the first audio signal, musical information characterizing at least a portion of the musical content;

generating a second audio signal that has at least one of a rhythmic relationship and a harmonic relationship with the musical information; and transmitting, substantially immediately after receiving the indication, the second audio signal to an audio output device, wherein receiving the first audio signal and extracting the musical information are associated with a learning mode, and generating a second audio signal and transmitting the second audio signal are associated with an accompaniment mode; and wherein, during both the learning mode and the accompaniment mode, the musical information is extracted from the first audio signal substantially continuously.

8. The non-transitory computer-readable storage medium of claim 7, wherein the second audio signal is transmitted no more than 40 milliseconds after receiving the indication.

9. The non-transitory computer-readable storage medium of claim 7, wherein the second audio signal is transmitted no more than one beat of a musical meter associated with the musical information after receiving the indication.

10. A musical accompaniment device configured to generate accompaniment for musical content included in a received audio signal, the device comprising:

an audio input device;

an audio output device;

a memory; and a processor that is coupled to the memory and the processor being configured to:

receive a first audio signal via an audio input device; and extract, from the first audio signal, musical information characterizing at least a portion of the musical content;

receive a musical characteristic associated with the musical information;

generate, based on the musical characteristic, a second audio signal that has at least one of a rhythmic relationship and a harmonic relationship with the musical information; and transmit, substantially immediately after receiving the first audio signal, the second audio signal to an audio output device, wherein the processor is further configured to receive the first audio signal and to extract the musical information in a learning mode, and wherein the processor is further configured to generate the second audio signal and to transmit the second audio signal in an accompaniment mode, and wherein, during both the learning mode and the accompaniment mode, the musical information is extracted from the first audio signal substantially continuously.

11. The musical accompaniment device of claim 10, wherein the processor is further configured to receive an indication to transition from the learning mode to the accompaniment mode.

12. The musical accompaniment device of claim 11, wherein the indication comprises at least one of a selection of a user interface (UI) element and closing a switch.

13. The musical accompaniment device of claim 10, wherein the processor is further configured to update musical information corresponding to a portion of the audio signal received in a most recent period of time having a predetermined length.

14. The musical accompaniment device of claim 10, wherein the second audio signal includes at least a portion of the first audio signal.

15. The musical accompaniment device of claim 10, wherein the processor is further configured to:

generate, based on the musical characteristic, a third audio signal that has at least one of a rhythmic relationship and a harmonic relationship with the musical information and includes additional information relative to the second audio signal; and subsequent to transmitting the second audio signal, transmit the third audio signal to an audio output device.

16. The musical accompaniment device of claim 10, wherein the musical characteristic comprises at least one of a key signature, a chord, a note pitch, a number of measures or bars, a time signature, a tempo, and a rhythm.

* * * * *